US006022093A

United States Patent [19]

Arai et al.

[11] Patent Number: 6,022,093

[45] Date of Patent: Feb. 8, 2000

[54] INK JET RECORDING APPARATUS AND METHOD

[75] Inventors: Atsushi Arai; Naoji Otsuka; Shigeyasu Nagoshi, all of Kawasaki; Kentaro Yano; Kiichiro Takahashi, both of Yokohama; Osamu Iwasaki, Tokyo, all of Japan

[73] Assignee: Canon Kabushiki Kaisha, Tokyo, Japan

[21] Appl. No.: 08/895,552

[22] Filed: Jul. 16, 1997

Related U.S. Application Data

[63] Continuation of application No. 08/451,974, May 26, 1995, abandoned, which is a continuation of application No. 07/992,293, Dec. 16, 1992, abandoned.

[30] Foreign Application Priority Data

Dec. 19, 1991 [JP] Japan ..... 3-336927
Dec. 19, 1991 [JP] Japan ..... 3-336944

[51] Int. Cl.[7] ..... B41J 2/05

[52] U.S. Cl. ..... 347/14; 347/7; 347/57

[58] Field of Search ..... 347/14, 17, 60, 347/86, 19, 10, 67, 191, 49, 7, 57

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. | 347/56 |
| 4,719,472 | 1/1988 | Arakawa | 347/17 X |
| 4,723,129 | 2/1988 | Endo et al. . | |
| 4,737,860 | 4/1988 | Ono . | |
| 4,740,796 | 4/1988 | Endo et al. . | |
| 4,740,800 | 4/1988 | Koyoshima | 347/67 |
| 4,746,937 | 5/1988 | Luc | 347/11 |
| 4,947,194 | 8/1990 | Kyoshima | 347/14 X |
| 4,970,533 | 11/1990 | Saito | 347/86 |
| 5,023,626 | 6/1991 | Kawamura | 347/14 X |
| 5,049,898 | 9/1991 | Arthur | 347/19 |
| 5,068,806 | 11/1991 | Gatten | 347/7 X |
| 5,122,816 | 6/1992 | Poeppez | 347/14 X |
| 5,162,817 | 11/1992 | Tajika | 347/7 |
| 5,182,580 | 1/1993 | Ikeda | 347/19 |
| 5,235,351 | 8/1993 | Koizumi | 347/19 X |

FOREIGN PATENT DOCUMENTS

| | | | |
|---|---|---|---|
| 0442705 | 8/1991 | European Pat. Off. | B41J 2/05 |
| 0443801 | 8/1991 | European Pat. Off. | B41J 2/05 |
| 59-123670 | 7/1984 | Japan | B41J 3/04 |
| 359148678 | 8/1984 | Japan | B41J 3/20 |
| 59-138461 | 8/1984 | Japan | B41J 3/04 |
| 362077949 | 4/1987 | Japan | B41J 3/04 |
| 401128851 | 5/1989 | Japan | B41J 3/20 |
| 03175051 | 7/1991 | Japan | B41J 2/175 |
| 89-02367 | 3/1989 | WIPO | B41J 3/04 |

OTHER PUBLICATIONS

Official Search Report for European Patent Appln. No. 92311624.8.

*Primary Examiner*—Joseph W. Hartary
*Attorney, Agent, or Firm*—Fitzpatrick, Cella, Harper & Scinto

[57] ABSTRACT

An ink jet recording apparatus for recording onto a recording medium by using a recording head for discharging the ink, comprising a heater provided in the recording head and a resistor provided externally of the recording head to determine the resistance of the heater provided in the recording head, thereby selecting the drive conditions of the recording head.

10 Claims, 20 Drawing Sheets

CHANGE OF INK DISCHARGE AMOUNT DUE TO PRINT DURABILITY AND MINIMUM DRIVING VOLTAGE

P1 : PRE-PULSE ( = T1)
P2 : INTERVAL ( = T2 - T1 )
P3 : MAIN PULSE ( = T3 - T2 )
Vop : DRIVING VOLTAGE

PRINCIPLE OF DISCHARGE AMOUNT CORRECTION (MINIMUM DISCHARGE AMOUNT CONSTANT)

PRINCIPLE OF DISCHARGE AMOUNT CORRECTION (DISCHARGE AMOUNT VARIATION MINIMUM)

PRINCIPLE OF DRIVING VOLTAGE CORRECTION

CHANGE OF INK DISCHARGE DUE TO PRINT DURABILITY
(TANK NEGATIVE PRESSURE EFFECT)

INK JET RECORDING APPARATUS AND METHOD

This application is a continuation of application Ser. No. 08/451,974 filed May 26, 1995, now abandoned, which in turn is a continuation of application Ser. No. 07/992,293, filed Dec. 16, 1992, now abandoned.

BACKGROUND OF THE INVENTION

1. Field of the Invention

The present invention relates to an ink jet recording apparatus for recording onto a recording sheet by discharging the ink thereto, and more particularly to an ink jet recording apparatus and method with the improvement of selecting the driving voltage optimal for the discharge heater provided in the recording head, or capable of achieving the proper recording in accordance with the number of ink tanks which have been used.

2. Related Background Art

Today, a wide variety of information recording apparatuses such as printers, facsimiles and word processors have been developed. As one of the recording methods for such recording apparatuses, an ink jet method has been widely used owing to its advantages such as high resolution, high speed recording, low cost, and compact size. In particular the compact size of the apparatus and the reduction in operating cost are important factors.

In a conventional ink jet recording apparatus, there is mounted an ink jet head unit 701 consisting of an ink discharge port 702, and a substrate 703 having signal contacts 704 and heater voltage ID circuits 705 as shown in FIGS. 1A and 1B.

The heater voltage for determining the ink discharge rate is selected from four values of heater voltage in order to compensate for production variations in heater resistance of the ink jet head unit 701. The selection of the heater voltage can be performed by a combination of cutting the four wiring patterns 706 for heater voltage ID circuit 705. An ink jet recording apparatus selects a heater voltage optimal for a recording head that has been exchanged from the four stages of heater voltages by a combination of cutting the wiring patterns 706 provided thereon, and supplies it to the recording head.

In such an ink jet recording head, however, owing to the necessity of a substrate 703 having signal contacts 704 and heater voltage ID circuits 705, it is desirable to reduce the volume of the substrate 703 as much as possible for an ink jet head associated with the advantage of the small head to achieve a further compactization of the head.

Also, it was requisite to cut the wiring patterns 706 by measuring the dispersion in heater resistances for each recording head after production, and by then selecting the optimal heater voltage on the basis of the measurement result.

On the other hand, the form of an ink tank supplied to the above-described recording head is one in which the tank is formed integrally with the recording head to be detachable together from the apparatus, or in which the tank by itself is detachable with the recording head freely detachable from the apparatus.

Recently, to provide a more compact; apparatus and to increase the life of the recording head, and to avoid environmental problems, a head tank integrated cartridge detachable therefrom having the latter construction has been noted.

In such cartridges in which the ink is arbitrarily refilled or the ink tank is periodically exchanged, there have been proposed some countermeasures against contaminants entering thereinto at the ink tank exchange.

However, the present inventors have revealed a phenomenon on the basis of many experiments that if the ink supply is arbitrarily or periodically conducted for the recording chips of recording head (e.g., one or more discharge ports, liquid channels, a liquid chamber, discharge elements such as electrothermal converting elements, and electric drive signal supply wirings), fluctuations in the ink discharge state will occur in short periods. Also, it has been found that with the constitution of exchanging a plurality of ink tanks after exhausting the ink within the ink tank to resume the recording, the stable recording period tends to be shorter than when using a large ink tank having an amount of ink sufficient for the recording chips to be recordable. In the light of this, the inventors have studied and confirmed that some failure may arise in the ink supply state before the exchange of ink tank, or the discharge elements themselves, thereby giving rise to such phenomenon.

Specifically, as one of its factors, due to characteristic changes of the discharge elements themselves which are discharge means, the change in the ink discharge amount is caused, and the minimum driving voltage is also changed, and in particular, in an ink recording head having electrothermal converters, this factor will greatly change the recording state. Accordingly, where the ink supply is arbitrarily or periodically conducted (particularly when the electrothermal converters are used), it is an important task to maintain the stable discharge performance for a long term, and to increase the life of recording head.

SUMMARY OF THE INVENTION

The present invention aims to provide an ink jet recording apparatus and method of adopting a constitution in which the selection of optimal drive conditions can be performed in an easy and secure manner to achieve the stable discharge of ink from the recording head.

An object of the invention is to provide an ink jet recording apparatus and method in which the stable discharge performance can be maintained for a long term without depending on the degree of replenishing the ink, with the advantage of replenishing the ink effectively utilized in practice.

A further object of this invention is to provide an ink jet recording apparatus and method which can provide a substantially longer recording head life with the change in the discharge properties caused by the degree of replenishing the ink suppressed.

Another object of the present invention is to provide an ink jet recording apparatus and method in which the longer service and the stable recording performance of recording head can be realized by altering the drive conditions of the recording head in accordance with the exchange of the ink tank for replenishing the ink, or preferably in accordance with the accumulation of recording with the ink tank using the same drive conditions.

A still further object of the present invention is to provide an ink jet recording apparatus and method in which the longer stable recording performance can be realized by altering the drive conditions of the recording head in accordance with both the exchange of the ink tank for replenishing the ink and the exchange of recording chips, or preferably in accordance with the accumulation of recording.

The first constitution for achieving the stable discharge of inks as the previously-described object is such that a heater provided in a recording head and a resistor provided externally of said recording head are used to determine the resistance of the heater provided in the recording head, thereby selecting the drive conditions of the recording head.

The driving voltage $V_{OP}$ of recording head is determined by a threshold voltage $V_{TH}$ at which the discharge becomes possible for a drive pulse width $P_{TH}$ that is useful as the reference in recording with some margin. That is, the following relation stands.

$$V_{OP}=K\times V_{TH} \quad (1)$$

Where K in this expression is a value for allowing a margin in the threshold voltage $V_{TH}$, normally about 1.3. The reason for requiring this margin is that the voltage applied on the discharge heater will vary depending on the number of nozzles used for the discharge in recording, in which this voltage may drop if a larger number of nozzles is used for the discharge.

Also, the threshold voltage $V_{TH}$ and the resistance $R_H$ for the discharge heater have a relation $$V_{TH}/R_H=\text{constant} \quad (2)$$

Using the relations (1) and (2), the driving voltage can be determined by reading the resistance of discharge heater.

However, setting the driving voltage $V_{OP}$ stepless with the dispersion in the resistances $R_H$ for discharge heater between recording heads will impose a large burden on the recording apparatus main body in the functional respects. Therefore, it is desirable to set a driving voltage at one of a plurality of different ranks provided stepwise as the driving voltage $V_{OP}$, The present invention is such that the recording apparatus itself reads the resistance of a discharge heater provided in the recording head to determine the driving voltage.

Referring now to FIG. 2, measurement means for determining the resistance of discharge heater will be outlined in below. One discharge heater $R_H$ and detection resistor $R_{INIT}$ are connected in series, and a detection voltage $V_{OB}$ at the highest voltage rank is applied thereto. This is intended to have the least effect of the internal resistor for use to lower the rank of detection voltage $V_{OB}$. However, to avoid a rise in temperature of the discharge heater, it is desirable that the width of the applied pulse at detection voltage $V_{OB}$ be as small as possible, and the detection resistor $R_{INIT}$ be a somewhat larger value than the discharge resistance $R_H$.

Then, there is a relation between the resistance $R_H$ for discharge heater and the terminal voltage $R_{INIT}$ across the detection resistor, $$R_H=(V_{OB}/V_{INIT}-1)\times R_{INIT} \quad (3)$$

so that the resistance $R_H$ for discharge heater can be known by detecting the terminal voltage $R_{INIT}$.

Next, the method of determining the driving voltage $V_{OP}$ based on the detected terminal voltage $R_{INIT}$ will be outlined below.

The analog signal of the terminal voltage $R_{INIT}$ detected by a circuit of FIG. 2 is converted into a digital signal by a DA converter, and the driving voltage $V_{OP}$ for the recording head is set by deciding to which of the plural predefined ranks the digital signal corresponds.

This setting of driving voltage is required to be performed when the recording head is mounted on the ink jet recording apparatus. To this end, while the power is being supplied to the recording apparatus itself, the setting of driving voltage should be performed when a signal is issued indicating whether the recording head is attached or detached upon contact or non-contact between recording head and head drive electrode. In this case, in a cartridge type head in which the ink tank is separable from recording head, only the ink tank is exchanged while the recording head is in contact with the head drive electrode, and thus there is no need for the confirmation as to whether the recording head is attached or detached.

When a unused recording head is mounted, there is no ink on the discharge heater, so that there is a risk that the temperature may rise more rapidly than when the ink remains thereon, thereby impairing the heater. In view of this respect, the width of the applied pulse at the detection voltage $V_{OB}$ in the measurement of resistance for discharge heater and the detection resistor $R_{INIT}$ should be set appropriately.

The discharge heater for the measurement of resistance may be a certain specific discharge heater, but considering that there is some dispersion in resistances of discharge heaters even within the same head, it is further preferable to determine the driving voltage $V_{OP}$ by connecting a plurality of discharge heaters in series or parallel, and measuring the resultant resistance of the plurality of discharge heaters.

Further, it is more preferable to determine the driving voltage $V_{OP}$ optimal for a plurality of discharge heaters by measuring individually their resistances.

When the power is not supplied to the recording apparatus itself, it is further preferable that this setting may be conducted upon initiating the power supply to the recording apparatus, because of not permitting a confirmation whether the recording head is attached or detached.

The second constitution to achieve the previously-described object is an ink jet recording apparatus for recording by the use of a recording head having integrally a recording chip having an ink discharge unit and an ink tank for reserving the ink, characterized in that the recording head is a separation-type head in which a plurality of ink tanks can be exchanged for a given recording chip, and comprises means for altering the drive conditions for the recording head in accordance with the number of ink tanks which have been used with the one recording chip.

According to the present invention, relatively stable recording can be made without regards to exchanging the ink tank for replenishing the ink. For example, when the ink tank is exchanged during recording, the image change which might otherwise occur on one page can be prevented, whereby even if the ink tank is exchanged while the same image is being recorded onto a plurality of sheets, uniform multi-recording for the same image can be accomplished.

The present invention includes the following specific inventions.

Because of the provision of the altering means having a mechanism for modifying the drive conditions for a recording head mounted thereon upon exchanging the recording chip for the apparatus, it is possible to make the recording more stable in a proper state by virtue of the ink tank integrally provided and without imposing an unnecessary load on the exchanged recording head.

In a constitution in which the recording head comprises a plurality of discharge ports and electrothermal converters, each corresponding to each discharge port, for generating the heat energy to form bubbles in the ink as the ink discharge unit, and the ink jet recording apparatus includes means for supplying a drive signal for driving the electrothermal converters in accordance with the recording signal, the present invention not only allows for the proper ink consumption efficiency within the ink tank, but also the stable recording characteristics at high levels while preventing the occurrence of overload conditions by giving appropriate drive conditions to the electrothermal converters, whereby the longer life of recording head can be comprehensively accomplished.

Note that the inventive method of including refilling the ink in the exchange of ink tank belongs to a higher-level invention than the present invention, and can be defined as "the number of supplying the ink to the recording chip with the ink tank". In this invention, the above described effects can be also obtained.

As an alternative example for the drive signal, if a drive signal has a preheating signal and a bubble forming main signal is supplied to the electrothermal converters at an interval, in particular, it is typically cited that the supply energy of this preheating signal is decreased in accordance with the number of supplying the ink. When this drive signal is used, it is possible to vary the amount of discharge ink minutely while preventing the overheating of the ink discharge unit, thereby resulting in more reliable characteristics. When the drive condition for ink discharge is the setting reference for the temperature adjustment of the recording chip or the ink, it is cited as an alternate example that the setting reference is decreased in accordance with the number of supplying the ink. This temperature adjustment allows the amount of ink discharge to be made proper in accordance with the change in the amount of discharge by changing relatively the temperature of and around the ink, thereby contributing to the longer life of recording head. It will be understood that specific preferable examples for altering will be clear from the description of the following example.

In addition, a more precise invention is an ink jet recording method for recording by supplying the ink from the ink tank to the recording chip having the ink discharge unit, characterized in that the recording is carried out by altering the drive conditions for ink discharge in accordance with the number of supplying the ink from the ink tank to the recording chip, and the rate of consuming the ink within the ink tank mounted. This invention can offer more precise effects and will be clear from the description by way of the following example.

A recording head of the present invention can be divided into an ink recording unit and an ink tank unit for supplying the ink to the ink recording unit, which should be smaller than their conventionally used constitutions to exhibit the effects of the present invention remarkably, but is not limitative. A disconnecting mechanism between the ink recording unit and the ink tank unit and a discriminating mechanism therefor are embodied within the scope of realizing the concept of the invention, and are not limited to the following examples.

DETAILED DESCRIPTION OF THE PREFERRED EMBODIMENTS

An embodiment involved in the first constitution will be described in detail with reference to the drawings.

(First Embodiment)

Figure 1A:
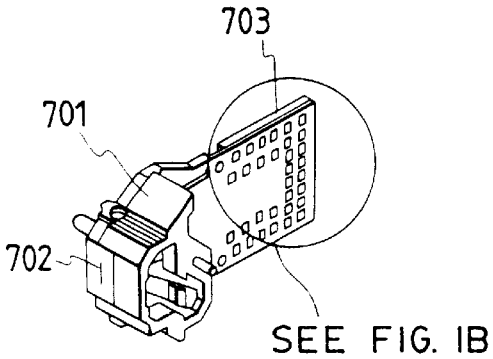
FIGS. 1A and 1B are a schematic perspective view and an enlargement thereof of an ink jet head unit as the background art concerning the present invention.
Figure 1B:
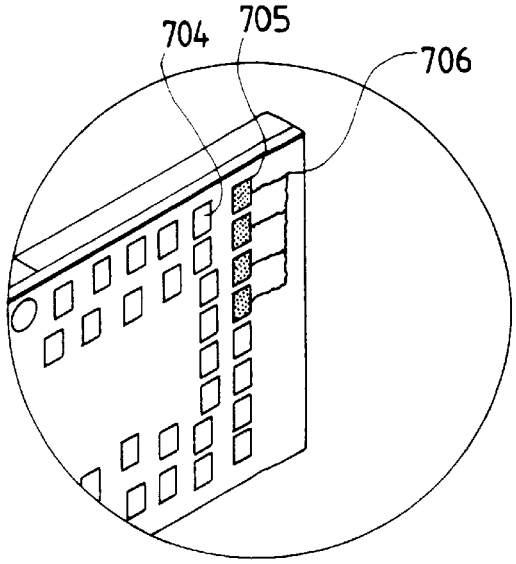
Figure 2:
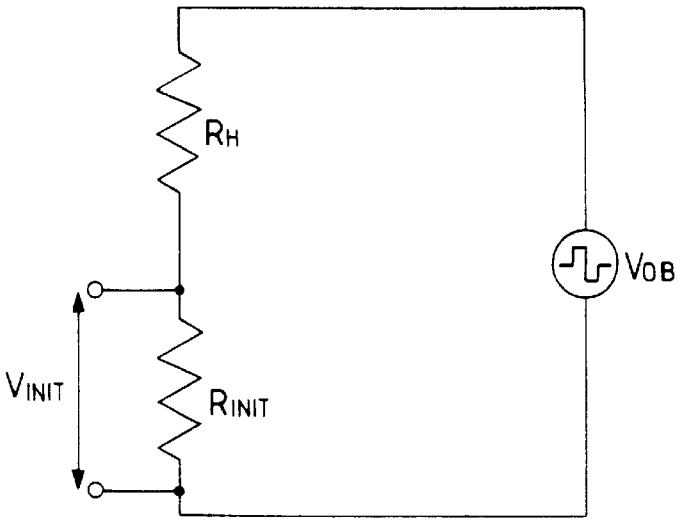
FIG. 2 is a view for explaining the outline of the present invention in which the driving voltage of a recording head is set by measuring the resistance of a discharge heater.
Figure 3:
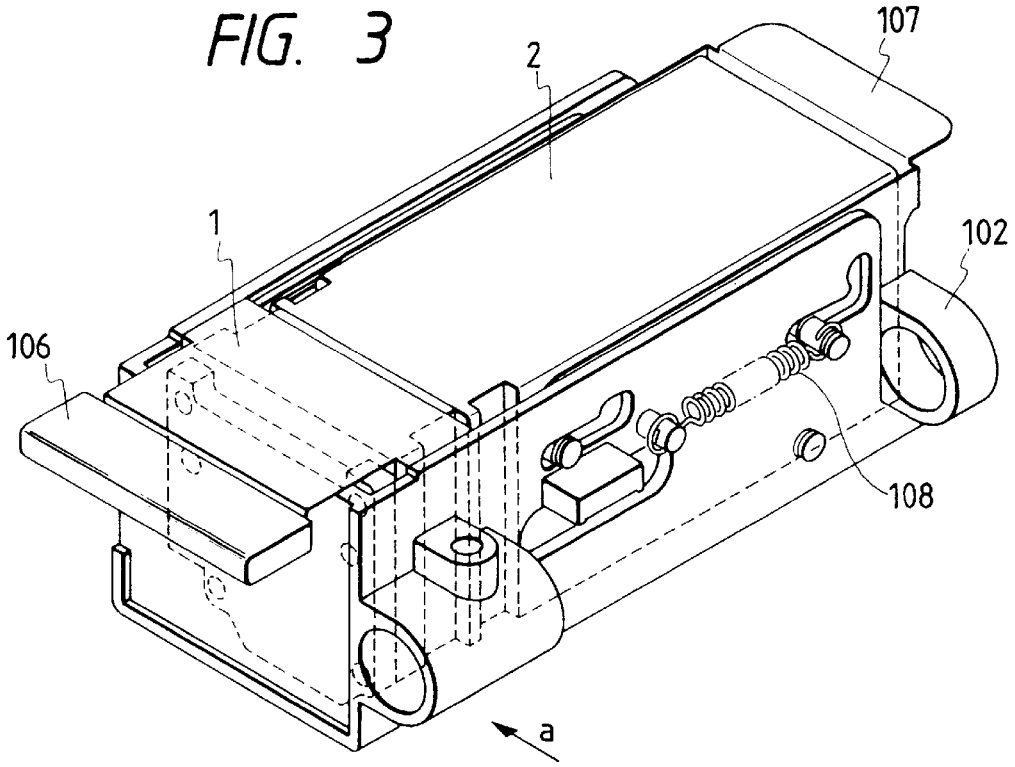
FIG. 3 is a schematic perspective view illustrating an ink jet recording head according to a first embodiment of the present invention.

FIG. 3 is a schematic perspective view illustrating a recording head unit and a carrier unit in a recording apparatus according to the embodiment of the present invention.

In FIG. 3, 1 is a recording head for discharging the ink upon an electric signal, 2 is an ink tank for reserving the ink for the supply to the recording head 1, 102 is a carrier provided on a recording apparatus main body for carrying the recording head 1 and the ink tank 2, 106 is a head lever for holding or releasing the recording head 1, 107 is an ink tank lever for loading or unloading the ink tank thereto or therefrom, 108 is a head securing spring for securing the recording head 1 to the carrier 102, whereby these components can constitute the recording head unit and the carrier unit for the recording apparatus.

Figure 4:
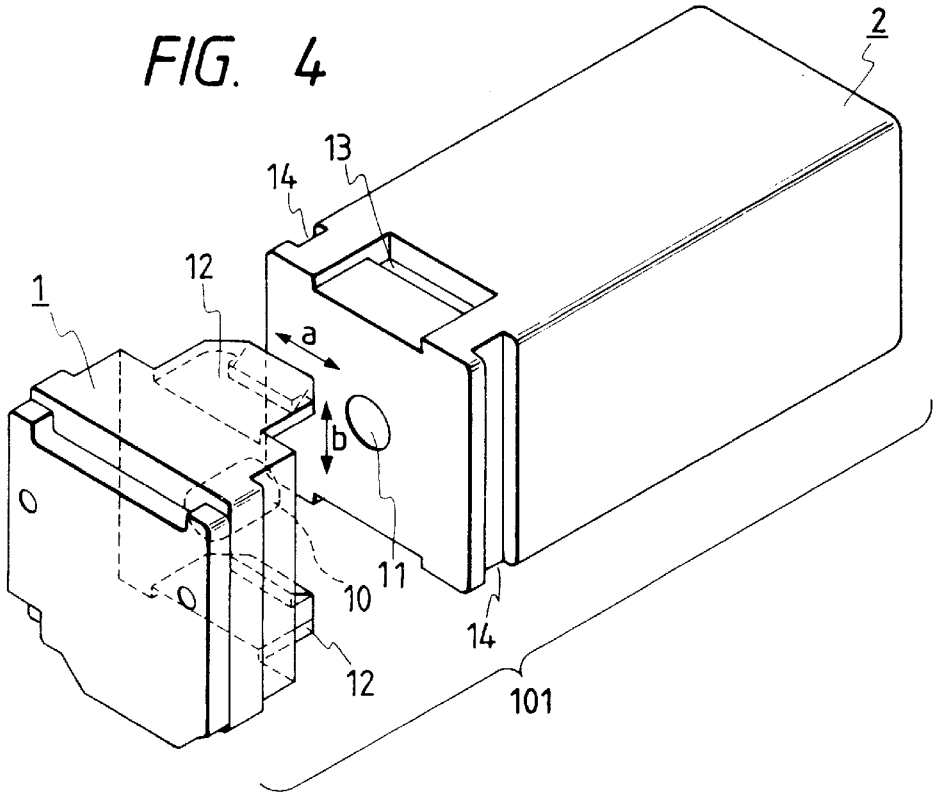
FIG. 4 is a schematic perspective view illustrating the first embodiment in partial enlargement.

FIG. 4 is a schematic perspective view illustrating the recording head 1 and the ink tank 2 for the recording apparatus according to the embodiment of the present invention.

In FIG. 4, 10 is an ink supply channel serving as a passage through which the ink is supplied from the ink tank 2 to the recording head, 11 is an ink supply orifice for supplying the ink from the ink tank 2 to the recording head 1, 12 is a coupling click for guiding and holding both the recording head 1 and the ink tank 2 in joining them, 13 is a coupling click guiding groove which is engaged by the coupling click 12, and 14 is an ink tank guide groove for holding the ink tank 2 in loading or unloading the ink tank 2 as well as the recording head 1, whereby these components can constitute a head cartridge 101.

The recording head 1 is constituted of a substrate having formed thereon a plurality of electrothermal converters for generating the heat energy for use in discharging the ink and a drive circuit for driving them, discharge ports and liquid channels each corresponding to a respective one of the plurality of electrothermal converters on the substrate, onto which a ceiling plate is laminated to form a common liquid chamber communicating with the liquid channels. And it is mounted on the apparatus so that a discharge port face having arranged discharge ports of the recording head thus constituted is faced to the recording medium.

The ink tank 2 is a tank for storing the ink which is supplied to the recording head 1 as appropriate to make up for the ink consumed in recording, wherein when the ink tank 2 singly exists, it is sealed off by sealing means not shown so that the ink may not leak through the ink supply orifice 11, which sealing means can be opened automatically or manually upon connecting it to the recording head 1 to enable the ink supply. Also, a mechanism for introducing the atmosphere from the outside according to the ink volume decreasing with the ink consumption may be provided. And a further mechanism for improving the recording quality while preventing the ink leakage by retaining the ink pressure for the supply to the recording head at a slightly negative pressure may be provided internally thereof.

The recording head 1 and the ink tank 2, When joined in the head cartridge 101, are used on a recording apparatus during recording operation, and a method of joining both together will be described next.

Fundamentally, the recording head 1 and the ink tank 2 are joined by coupling together the ink supply channel 10 and the ink supply orifice 11, in which the ink leakage or the entry of the air into ink channels is prevented. In this embodiment, a method of utilizing the elasticity of a mold member is adopted. However, the ink supply channel 10 and the ink supply orifice 11 are not limitative to the mold member, but may be one having the seal feature.

In joining the recording head 1 and the ink tank 2, it suffices to simply couple the ink supply channel 10 and the ink supply orifice 11, but to prevent the uncoupling thereof with an unexpected external force exerted in manipulating the head cartridge 101, or to serve as a guide for easy unification in joining them, the coupling claw or click 12 and the coupling click guide groove 13 are provided in this embodiment to strengthen the connection. That is, the coupling click 12 molded integrally with the ink supply channel 10, and elastically deformable, is provided with a projection at its top end, whereby it can engage the coupling click guide groove 13 in such a manner as to cause the coupling click being elastically deformed by the amount of height of this projection to advance on the guide groove 13, until the projection of the coupling click 13 reaches a deep portion of the coupling click guide groove 13 provided backward.

Further, the coupling click 12 plays a role of the guide so that the ink supply channel 10 and the ink supply orifice 11 can be easily coupled in joining the recording head 1 and the ink tank 2. That is, the coupling click 12 is longer in size than the ink supplied channel 10, so that the coupling click 12 comes into contact with the ink tank 2 before the ink supply channel 10 is in contact with the ink supply orifice 11. Herein, the top end of the coupling click 12 is obliquely cut away, whereby the coupling click 12 can easily engage the coupling click guide groove by virtue of this oblique portion as a guide in a direction of the arrow a in shown FIG. 4. Also, the projection provided at the top end of the coupling click 12 is obliquely cut away, thereby serving as a guide in a direction of the arrow b in FIG. 4 to facilitate the coupling.

While the coupling click is provided on the side of recording head in this embodiment, it should be noted that besides that side, it may be provided on the side of the ink tank 2 or both sides of the recording head 1 and the ink tank 2.

Next, a method of connecting the recording head 1 with the carrier 102 mechanically or electrically will be described.

Figure 5:
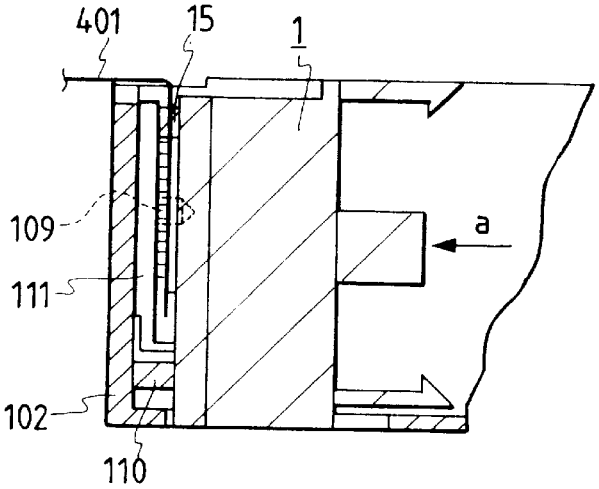
FIG. 5 is a side cross-sectional view illustrating the first embodiment in partial enlargement.

FIG. 5 is a cross-sectional view illustrating a connecting portion of the recording head 1 with the carrier 102, when viewed from a direction of the arrow a in FIG. 3. In FIG. 3, 109 is a positioning pin for positioning vertically in the figure and perpendicularly to the paper face, which is fixed on the carrier 102 to engage a hole provided in the recording head 1, 110 is a stopper for accepting the recording head 1 pressed in the direction of the arrow a in FIG. 3, which is fixed on the carrier 2, 401 is a flexible cable for the electrical connection between recording apparatus main device and the recording head 1, 111 is a pad for elastically supporting the flexible cable 401, which is carried between the flexible cable 401 and the carrier 102, and 15 is a contact portion provided in the recording head, which is electrically connected to a heater portion within the recording head 1.

The recording head 1 is pressed via a lever (not shown) by a head securing spring 108 in the direction of the arrow a at a position which is uniquely determined by the engagement between the hole provided on the recording head 1 and the positioning pin 109, and the interference with the stopper. In this way, the recording head 1 and the carrier 102 can be connected mechanically.

There are provided a plurality of electrical contacts on the contact portion 15 provided on the recording head 1 and an end face of the flexible cable 401 at their opposing positions, whereby the recording apparatus main device and the recording head 1 can be electrically connected by forcing them together with a predetermined pressure. In this case, since it is necessary that the plurality of electrical contacts are pressure welded at a time, the pad 111 made of an elastic material is provided in a pressing portion so that they may be pressure welded evenly. The material of the pad 111 may be silicone rubber, with the reaction force generated by pressing being significantly smaller than the force of the head securing spring 108 which presses down the recording head 1.

Particularly, the electrical contacts provided on the flexible cable 401 may be configured as projections to make the connection securer by concentrating the stress when being pressed.

The electrical or mechanical connecting portion is provided in the recording head side in this embodiment, but being not limitative, it may be appreciated that they may be provided on the side of the ink tank 2, or both sides of the recording head 1 and the ink tank 2, or the electrical connecting portion and the mechanical connecting portion may be separately provided on either side.

Next, a method for handling the recording head 1 and the ink tank 2, that is, for exchanging the ink tank 2 having exhausted the ink for a new ink tank 2, or exchanging the recording head 1 made unusable due to some cause, will be described.

As the first form, there is provided a method in which by releasing the connection between recording head 1 and carrier 102, and taking out the recording head 1 and the ink tank 2 which are joined from the carrier 102, the recording head 1 and the ink tank 2 are separated or unified in a state outside of the carrier 102 (thereinafter referred to as off-carrier state).

Figure 6:
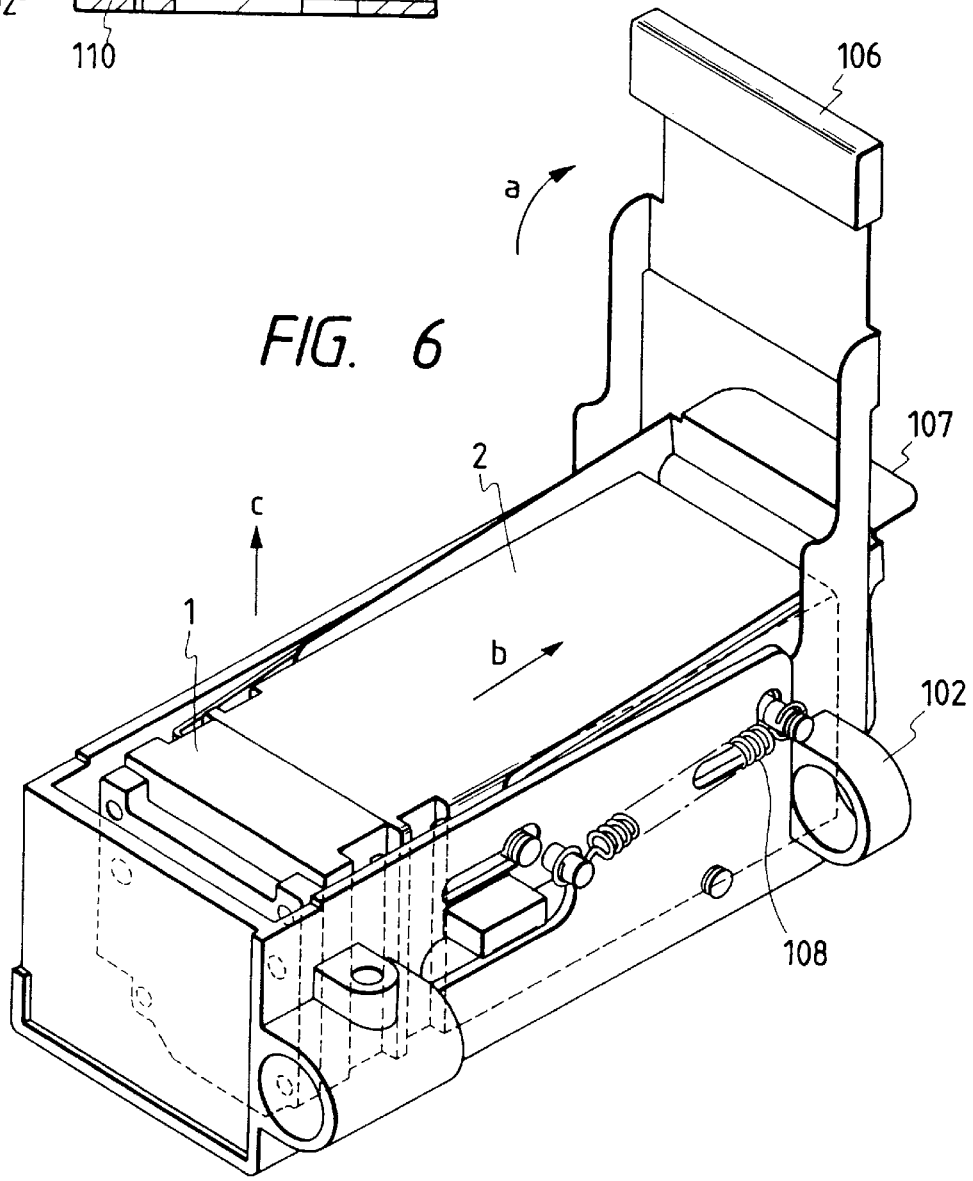
FIG. 6 is a schematic perspective view illustrating an exchange method of the first form according to the first embodiment.

FIG. 6 is a schematic perspective view illustrating how to take out the recording head 1 and the ink tank 2 which are joined from the carrier 2. In this case, the head lever 106 is turned and pulled upward from a state of FIG. 3 in a direction of the arrow a in FIG. 6 to a position as shown, thereby releasing the pressing force with the head securing spring 108 against the recording head 1. The recording head 1 and the ink tank 2 which remain joined are moved in a direction of the arrow b in FIG. 4, by means of a lever not shown within the carrier 102. As the engagement of the positioning pin 109 with the hole of the recording head 1 is thereby released, the recording head 1 and the ink tank 2 which remain joined can be moved in a direction of the arrow c in FIG. 6 to be placed in the off-carrier state. After the off-carrier state, the recording head 1 and the ink tank 2 can be separated by applying a force in a direction opposite to the direction of connecting them for unification. And either the recording head 1 or the ink tank 2 is exchanged for a new one, both are joined in a unification method as previously described and stored within the carrier 102 in a reverse procedure, and thus the exchanging operation is completed.

The pressing force against the recording head 1 is released by means of the head lever 106 in this embodiment, which is not limitative, but it will be appreciated that the lever pressing against the recording head 1 may be directly moved. Also, the recording head 1 is secured under pressure by means of the head securing spring 108, which is not limitative, but it will be appreciated that a latch hook having the spring property may be used to secure the recording head 1.

Further, the recording head 1 and the ink tank 2 may be attached or detached as a unit against the pressing force by directly taking up the recording head 1 by hand.

The first form can offer the following effects.

When either one of the recording head and the ink tank is to be exchanged, only it need be exchanged, resulting in the improvement of economy.

Since the recording head 1 and the ink tank 2 can be exchanged as a unit, changes in recording color can be simply achieved by removing the recording head and the ink tank with the ink color to be changed as a unit and exchanging for another unit.

The second form is a method in which the recording head 1 and the ink tank 2 are separated on the carrier (thereinafter referred to as "on-carrier state") while the recording head 1 is secured to the carrier 2.

Figure 7:
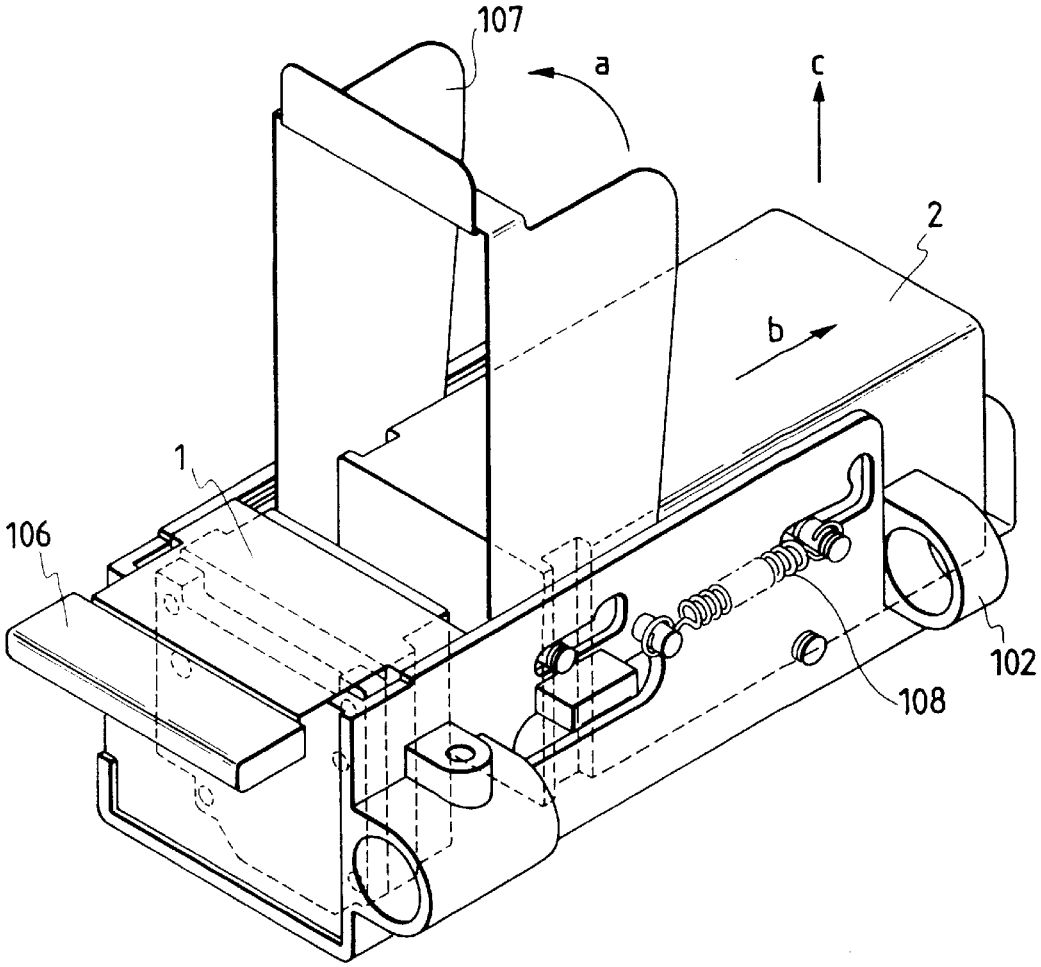
FIG. 7 is a schematic perspective view illustrating an exchange method of the second form according to the first embodiment.

FIG. 7 is a schematic perspective view illustrating a state where the ink tank is separated from the recording head 1 on the carrier 102. In this case, the tank lever 107 is turned and pulled upward from a state of FIG. 3 in a direction of the arrow a in FIG. 7 to a position as shown, upon which a lever not shown within the carrier 102 engages an ink tank guide groove 14 provided on the side face of the ink tank 2 to move in a direction of the arrow b. At this time, the recording head 1 is secured in the same state as shown in FIG. 3, and can not move along with the ink tank 2, so that the recording head 1 and the ink tank 2 are disenagaged and thus can be separated. Further, the ink tank 2 can be disengaged from the carrier 102 by moving the ink tank 2 in a direction of the arrow c in FIG. 5.

Figure 8:
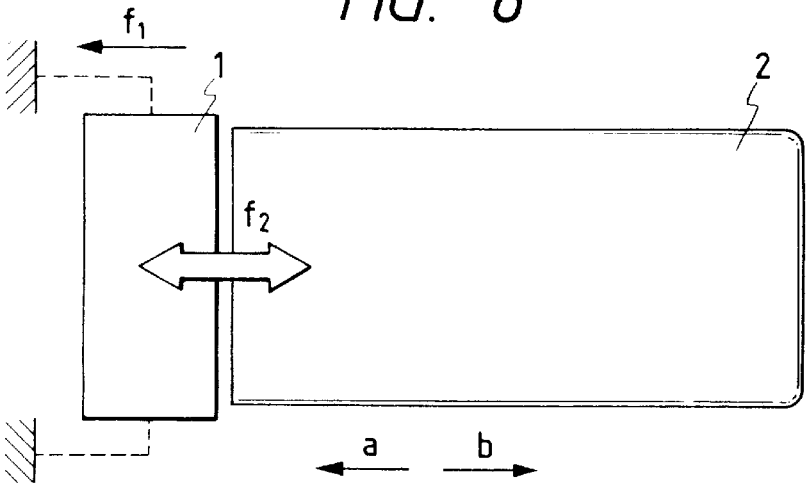
FIG. 8 is a schematic plan view representing how the force is applied in the first embodiment.

Note that when the recording head 1 is elastically pressed by the head securing spring 108 as in this embodiment, there is a possibility that the recording head 1 may be unsecured due to a force applied by the separation, and therefore the following constitution is preferred. FIG. 8 is a schematic plan view illustrating how the force is applied. In FIG. 8, the recording head 1 is pressed against the carrier 102 under a force f1 by the head securing spring 108. In separating the recording head 1 and the ink tank 2, a force f2 is necessary to disengage the coupling click 12 from the ink supplied channel 10. Providing the force such as f1>f2, it is possible to prevent the recording head 1 from being unsecured during separation operation.

While in this embodiment the recording head 1 and the ink tank 2 are separated with a force as large as f2 by means of the tank lever 107, which is not limitative, it will be appreciated that the recording head 1 and the ink tank 2 may be separated by directly taking up and pulling the ink tank 2 in the direction of the arrow b in FIG. 7.

The second form can offer the following effects, in addition to those of the first form.

That is, the pulling speed for separation can be controlled by appropriately designing the cam shape of the tank lever 107, so that scattering of the ink through the ink supplied channel 10 and the ink supply orifice 11 can be prevented.

As the recording head 1 is not directly moved by hand, the user does not touch the vicinity of an ink discharge nozzle of the recording head 1, so that unnecessary contamination having adverse effects on the recording can be prevented.

Since the force is applied to a specific portion of the ink tank 2, it suffices to provide a durable structure against the force to only that portion, with the other portion thinner, resulting in lighter weight, increased volume of content, and others.

Next, the recording apparatus having the recording head 1, the ink tank 2 and the carrier 102 mounted thereon will be described in connection with the constitution and operation.

Figure 9:
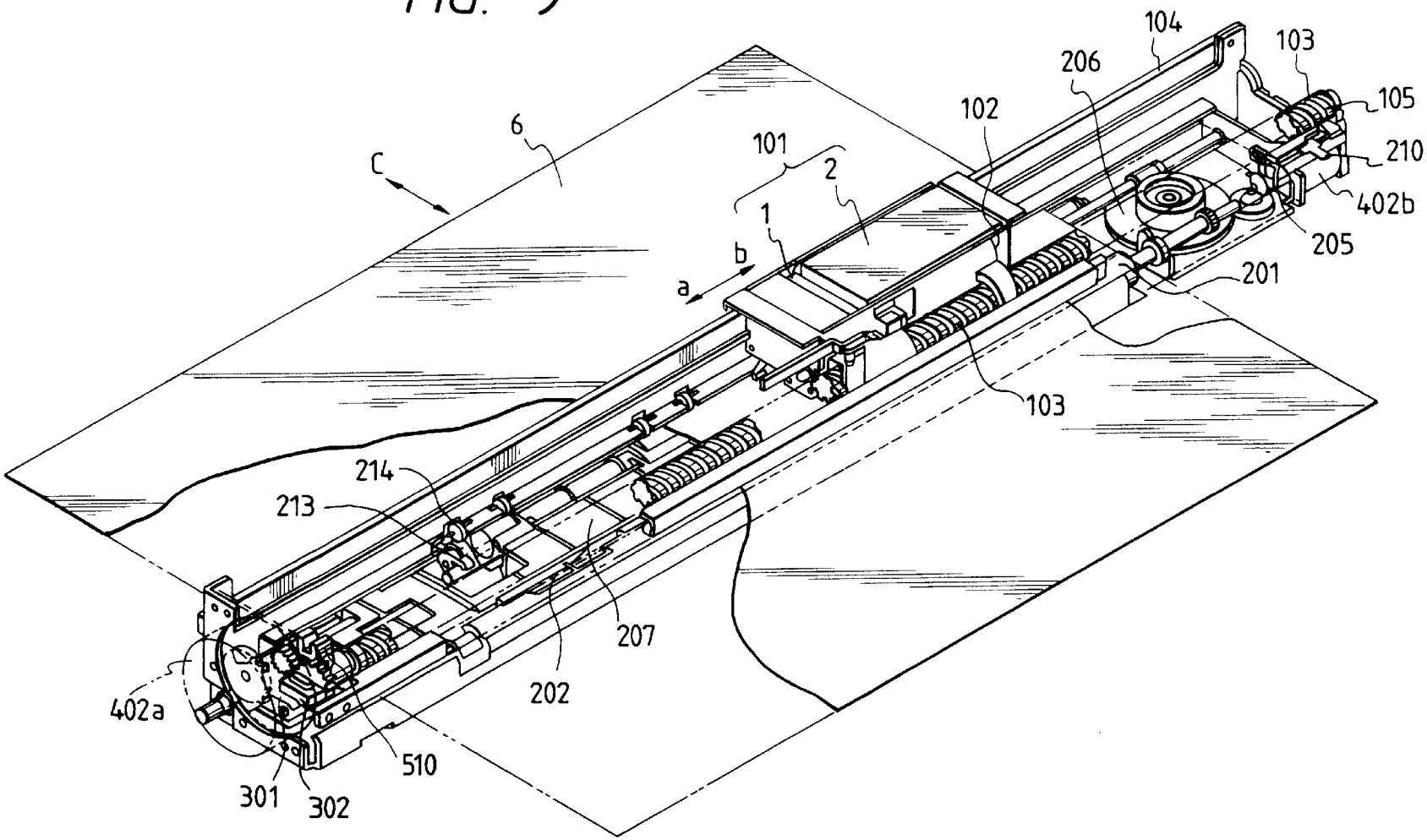
FIG. 9 is a schematic perspective view illustrating an ink jet recording apparatus as a whole according to the first embodiment of the present invention.

FIG. 9 is a schematic perspective view illustrating schematically the recording apparatus according to this embodiment.

The carrier 102 having the head cartridge 101 mounted has a pin (not shown) engageable with a helical groove 105 of a lead screw 103 rotating via a transmission mechanism not shown with positive or reverse rotation of a carrier motor 402*a*, and is reciprocatingly movable in directions of the arrow a and b along with the rotation of the lead screw 103. 104 is a slide rail for restricting the motion of the carrier. Also, the carrier 102 determines a position (home position) in the directions of the arrow a and b by means of a carrier sensor 510. 301 is a recovery unit having a cap 302 which is placed opposed to a discharge port face of head cartridge 101 at a predetermined position (e.g., home position) out of a recording range of the head cartridge 101, and a cap movement drive unit (not shown) for bringing the cap 302 into contact with the discharge port face to protect it when not used. Also, a pump for making excellent the ink discharge condition by sucking (clearing) the ink through discharge ports and discharging thickened ink, dust and bubbles in the contacted state, and a member for reserving the waste ink cleared are provided.

Further, a wiper (not shown) for cleaning the peripheral portion of discharge port for the head cartridge 101 is provided.

201 is a conveying roller for conveying a recording medium 6 in a direction of the arrow c in FIG. 6, and 202 is a pinch roller for pressing the recording medium 6 against the conveying roller 201, whereby the recording medium 6 is fed intermittently in a direction of the arrow c in the figure at the time of recording, while being carried between such a pair of rollers. The conveying roller 201 engages a conveying motor 402*b* via a transmission mechanism consisting of a conveying roller gear 205 and a conveying roller idler gear 206 to receive the transmission of a driving force. The pinch roller 202 can be brought into or out of contact with the conveying roller 201 by the operation of a release lever 210.

207 is a platen for regulating a recording face of the recording medium to be flat. And there may be provided a member for preventing the floating of recording medium 6 by placing it into intimate contact with the platen 207.

213 is a paper discharge roller rotating synchronously with the conveying roller 201 to discharge the recording medium 6 as already recorded toward a direction of the arrow c in FIG. 6, and a spur roller 214 which is driven is provided at a position opposed to the paper discharge roller 213 via the recording medium 6. With these rollers, the recording medium 6 is discharged out of the printer after the completion of recording.

Next, an information processing apparatus with the recording apparatus of this embodiment incorporated will be described in connection with the constitution and the electric circuit.

Figure 10:
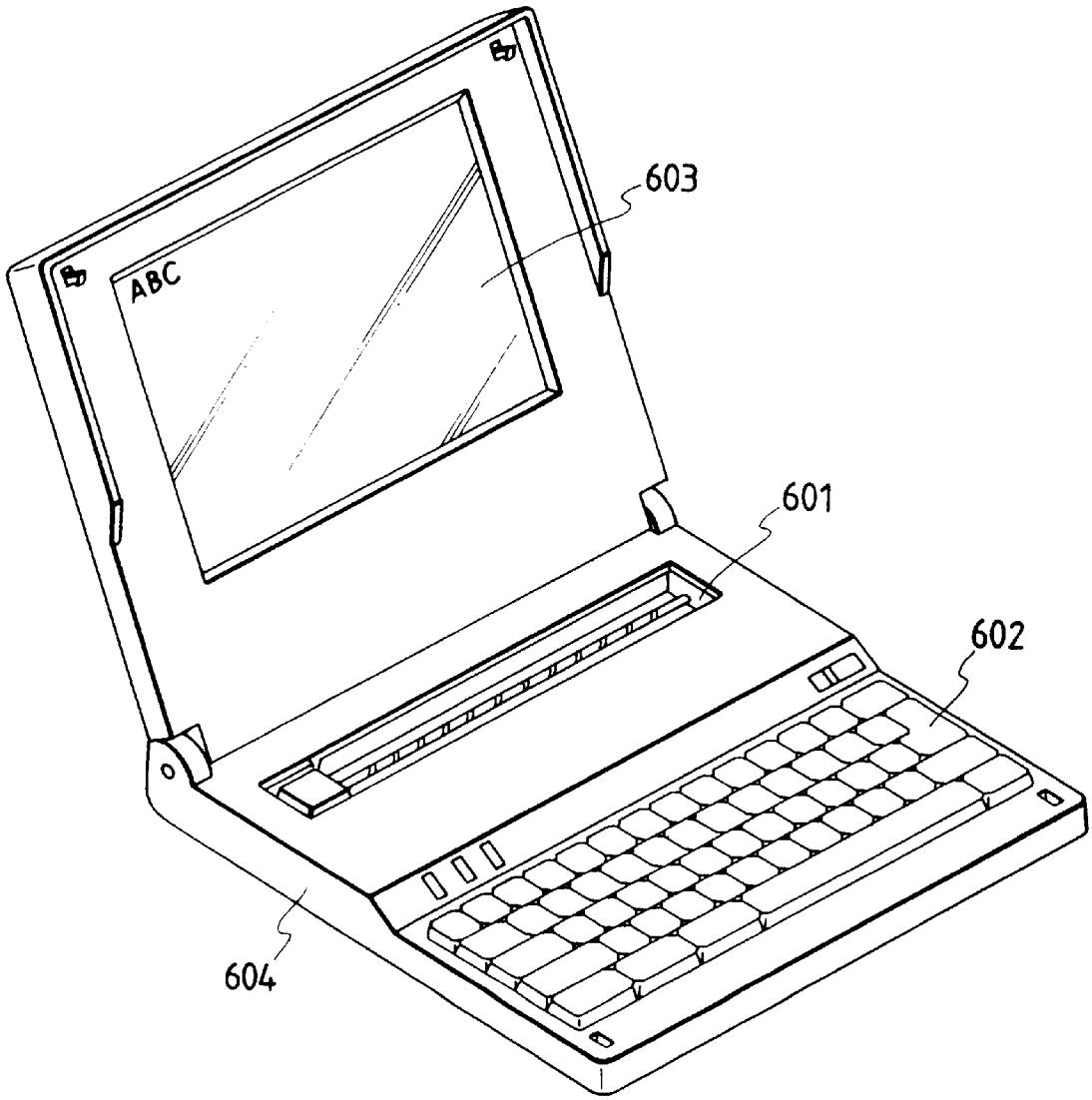
FIG. 10 is a schematic perspective view illustrating an information processing apparatus using the ink jet recording apparatus according to the present invention.

FIG. 10 is a schematic perspective view representing an appearance of the information processing apparatus with the recording apparatus of this embodiment incorporated thereto.

In FIG. 10, 601 is a printer unit as above mentioned, 602 is a keyboard unit comprising keys for entering letters, numbers and other characters, and keys for issuing a variety of commands, and 603 is a display unit having a display.

Figure 11:
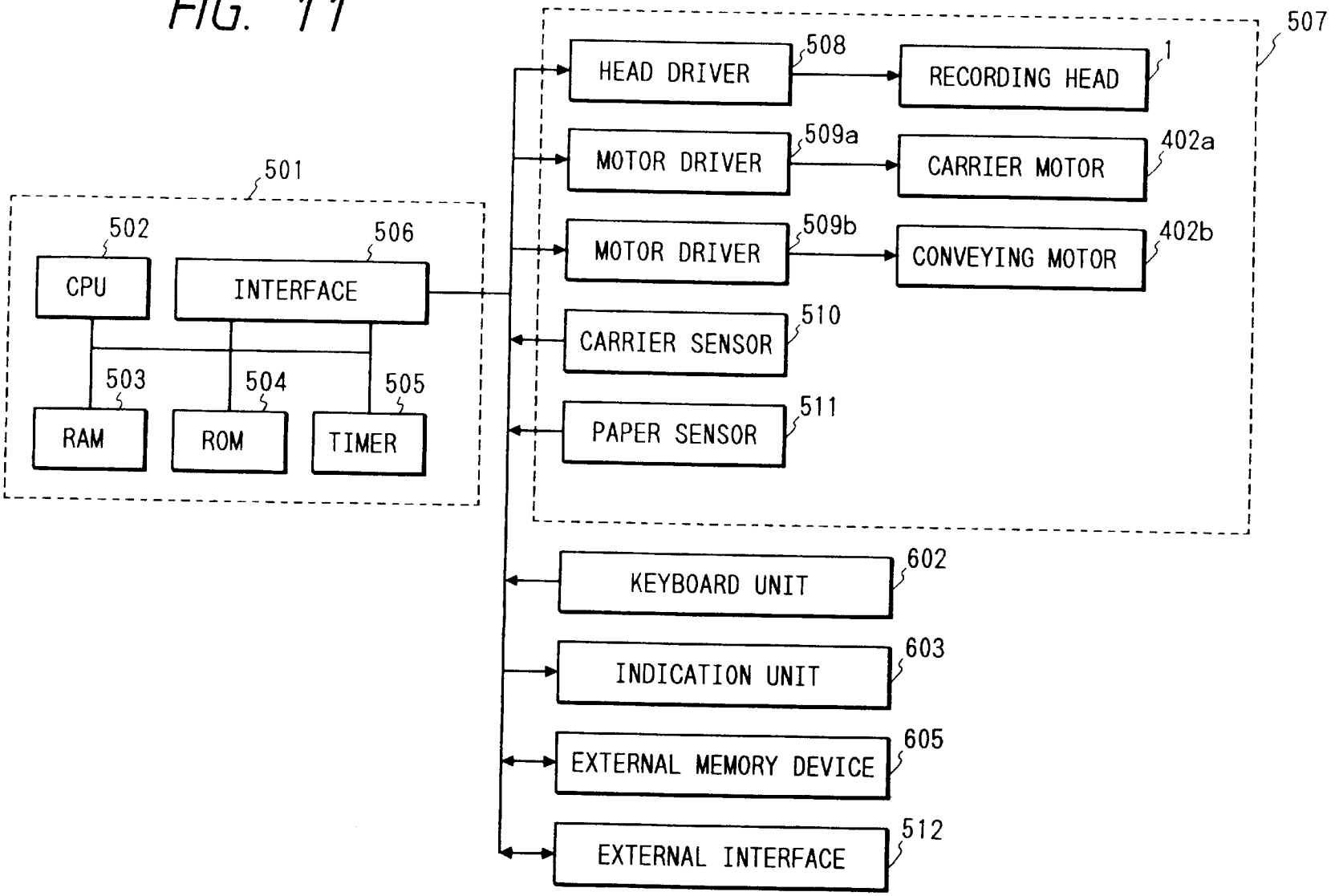
FIG. 11 is a block diagram of an electric circuit in the information processing apparatus using the ink jet recording apparatus according to the present invention.

FIG. 11 is a block diagram representing an electric circuit configuration of the information processing apparatus of this embodiment.

In FIG. 11, 501 is a controller for making the main control, 502 is a CPU in the form of a microcomputer, for example, to execute certain procedures, 503 is a RAM having an area for expanding text data or image data, and a work area, 504 is a ROM for storing fixed data such as programs corresponding to the procedures and other fonts, 505 is a timer for providing the timing necessary to create the execution cycle of CPU 502 or to make the recording operation with the printer unit 601, and 506 is an interface portion for interfacing the signal from the CPU 502 to peripheral devices.

Also, 507 is a controller for the printer unit 601, 508 is a head driver for delivering a recording signal or the power to the head cartridge 101, 509*a*, 509*b* are motor drivers for delivering a signal or the power necessary for driving the carrier motor 402*a* and the conveying motor 402*b*, respectively, 510 is a carrier sensor for sending the position of carrier 102 to determine whether or not the carrier 102 is positioned at a home position, for example, and 511 is a paper sensor for detecting the presence or absence of the recording medium 6 to prevent the recording on other than the recording medium 6 when the recording medium 6 is not inserted or the recording is completed to the page end.

Further, 605 is an external storage such as FDD, HDD, and RAM card, and 512 is an external interface for allowing to communicate with other information processing apparatuses, or control peripheral devices via internal bus directly connected.

Note that while being not included in the block diagram of FIG. 11, there is provided a power supply unit for supplying the power to the above electric circuit, examples of which include a charge-type battery, a disposable cell, or an AC power converter useful when the information processing apparatus is fixed.

Figure 12:
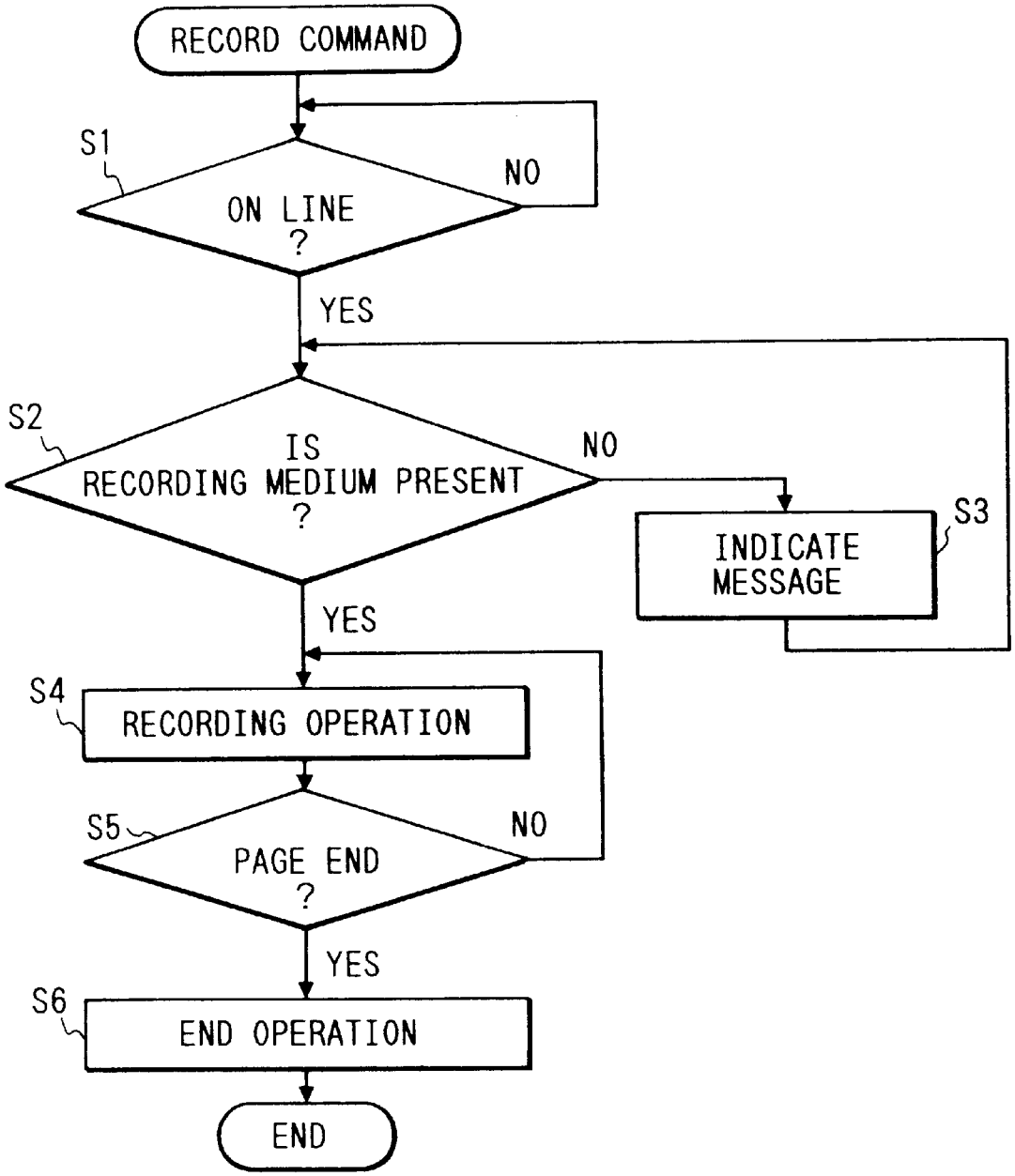
FIG. 12 is a flowchart representing the recording operation in the first embodiment.

While in the electric circuit configuration as previously described, the recording apparatus records onto the recording medium 6, the outline of recording operation control sequence will be described with reference to a flowchart of FIG. 12.

The following series of procedures start upon a recording start command with a recording command key on a display operation unit of printer main body, or from the outside through the external interface.

First, at step S1, the online state of display operation unit is judged. This is a countermeasure taken to prevent the recording operation from starting while the printer is not ready, when a recording operation start command is sent from the outside. If the display operation unit is judged to be online, the routine proceeds to step S2.

At step S2, the presence or absence of a recording medium 6 set in the printer unit is judged on the basis of a signal from the paper sensor 511. This is to prevent the ink from scattering over the printer unit and contaminating the apparatus itself, or prevent the recording medium or the ink from being wasted, when the recording is started without recording medium in the recording apparatus such as particularly the ink jet printer.

Further, at step S2, whether or not pinch roller 202 and conveying roller 201 are released, as well as the presence or absence of recording medium, may be judged. This is to prevent the abnormal conveyance of the recording medium when the pinch roller 202 is released even if the recording medium 201 is set. For the judgment as to whether the pinch roller 202 is released, for example, means having a mechanical switch for the release lever may be provided. Herein, if the recording medium is not normally set, the routine proceeds to step S3.

At step S3, a message is issued to provoke the operator to set a recording medium. The method of indicating the message relies on a light or a buzzer on the display operation unit, for example.

If the presence of recording medium 6 is judged at step S3, the routine proceeds to step S4.

At step S4, the recording operation is started. With a command from the CPU 502, the head driver 508 drives the head cartridge 101, and synchronously therewith, the motor drivers 509*a*, 509*b* drive the carrier motor 402*a* and the conveying motor 402*b*, respectively, whereby the recording is performed with the movement of the carrier 102 in a main scan direction and the movement of the recording medium in a sub-scan direction, as well as the cleaning of the recording head 1.

Finally, at step S5, the recording operation end is judged, in which for example, the recording operation end is determined if a signal indicating the operation end is issued from the CPU 502, a predetermined line number of one page in the sub-scan direction is reached so that the recording is not allowed on the recording medium, or no recording area on the recording medium 6 is sensed by the paper sensor 511.

As a procedure for the recording operation end at step S6, the carrier 102 is first returned to a home position. This is to cap and protect the ink discharge port face of the recording head 1, preparatory to turning off the power after the completion of the recording operation. Then, the recording medium is discharged by driving the conveying motor 402*b* by a predetermined amount, or until it is confirmed by the paper sensor 510 that the recording medium is discharged. And the recording operation is terminated by the CPU 502 which then displays a recording end on the display operation unit, or informs it to peripheral devices through the external interface.

As in this above-described embodiment, the recording head and the ink tank are separable, and the ink jet recording apparatus is constituted by allowing the separating or unifying operation to be performed on the carrier or outside of the carrier, whereby there are following effects.

That is, as the ink tank is mounted on the carrier, any tube for the ink supply is unnecessary, resulting in the compactization of the apparatus.

When the ink is used up, it suffices to exchange only the ink tank, rather than the cartridge integral with the head, resulting in the reduction of operating costs.

When either one of the recording head and the ink tank is to be exchanged, it alone can be exchanged, resulting in the improvement of the economy.

When the recording head and the ink tank are separated on the carrier by a lever, the pulling speed can be controlled, so that scattering of the ink through the ink supply channel 10 and the ink supply orifice 11 can be prevented.

Also, when the recording head and the ink tank are separated on the carrier, the user need not hold the recording head by hand to touch the ink discharge nozzle of the recording head 1, so that unnecessary contamination exerting adverse effect on the recording can be prevented.

Also, when the recording head and the ink tank are separated on the carrier, the force is applied to a specific portion of the ink tank 2, and thus it is only necessary for that specific portion to have a durable structure to withstand that force, with the other portion thinner, resulting in the lighter weight and the increased volume of content.

When the ink color is to be changed, the ink color is not mixed, because the recording head and the ink tank can be exchanged as a unit, whereby there is the advantage that the ink color can be easily changed.

Next, to explain an embodiment in which the optimal drive voltage is supplied to a discharge heater provided on the recording head by measuring the resistance of heater, the outline of the information processing apparatus using the ink jet recording apparatus according to the present invention will be described with reference to a schematic view of FIG. 13.

Tank information TM as to whether or not the ink tank IJT is attached to the recording head IJH is passed via a signal terminal T1 of recording head IJH and a terminal T3 of carriage IJC to controlling means CC. The controlling means CC discriminates whether or not the ink tank IJT is attached to the recording head IJH, based on a discriminating table stored in a tank discriminating table TT.

Head information HM as to the resistance and others of discharge heater H provided in the recording head IJH is passed via a terminal T2 of carriage IJC to controlling means CC. The controlling means CC discriminates the resistance and others of discharge heater H provided on the recording head IJH, based on a discriminating table stored in a head discriminating table HT. The controlling means selects a drive condition optimal for the resistance of discharge heater H from a drive condition table, based on its discriminating information. And the controlling means CC controls head driving means HD to drive the recording head IJT in the optimal drive condition selected.

Figure 14:
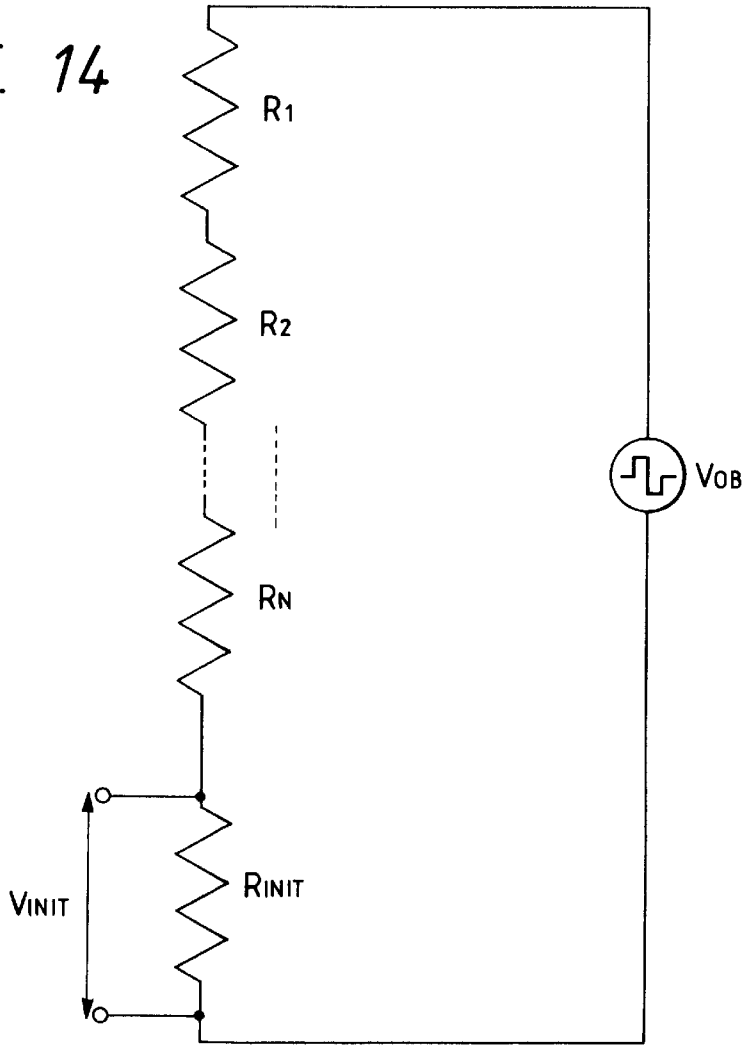
FIG. 14 is a diagram for explaining an embodiment in which the resistance for discharge heater is measured and the driving voltage for the recording head is set.

Next, an embodiment in which the drive voltage of the recording head is set by measuring the resistance of discharge heater will be described below with reference to FIG. 14.

The resistance of a single discharge heater may be measured, but it is necessary to take into consideration the dispersion in the resistances of discharge heaters within the same head. Hence, in this embodiment, the resistors of discharge heaters having N nozzles and a detection resistor $R_{INIT}$ are connected in series, and a voltage $V_{OB}$ is applied thereto. Then, the relation between the resistance $R_N$ of discharge heater and a terminal voltage $V_{INIT}$ across the detection resistor is $$R_1+R_2+\ldots+R_N=(V_{OB}/V_{INIT}^{-1})\times R_{INIT} \quad (4)$$

The average value R of the resistances of discharge heaters is $$R=(R_1+R_2+\ldots+R_N)/N=(V_{OB}/V_{INIT}^{-1})\times R_{INIT}/N \quad (5)$$

and therefore R can be known by detecting $R_{INIT}$.

The constitution and determining method except for detecting $V_{INIT}$ is the same as in the aforementioned outline, wherein a detection voltage $V_{OB}$ at the highest rank voltage is applied to a circuit having the resistors of discharge heaters and the detection resistor $R_{INIT}$ connected in series, an analog signal of detected terminal voltage $R_{INIT}$ is converted into a digital signal by DA converter, and the drive voltage $V_{op}$ is determined by discriminating to which rank among the predefined multiple ranks of drive voltage the terminal voltage corresponds.

(Second Embodiment)

Figure 15:
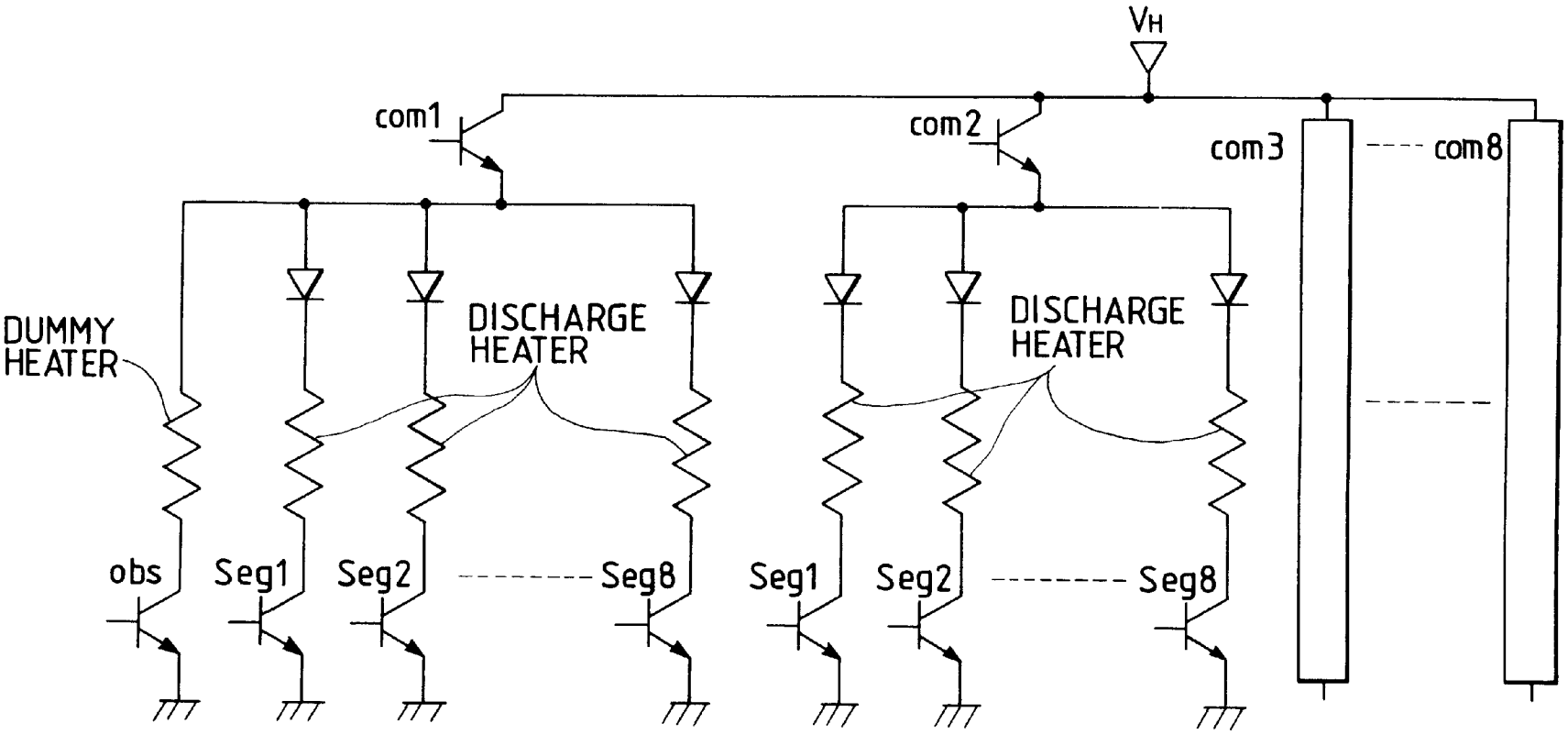
FIG. 15 is a diagram for explaining another embodiment in which the resistance for discharge heater is measured and the driving voltage for the recording head is set.

Another embodiment of setting the drive voltage $V_{op}$ will be described below with reference to FIGS. 15 and 16.

The recording apparatus main device in this embodiment has multiple driving voltages $V_R$ ($V_R=V_{R1}, V_{R2}, \ldots$). A heater (thereinafter referred to as dummy heater) of the same type as the discharge heater is fabricated outside of the nozzle in the recording head by the same film formation process to produce a circuit as shown in FIG. 13. By measuring the resistance of this dummy heater in setting the driving voltage, it is possible to avoid the failure of impairing the discharge heater when the voltage $V_{OB}$ is applied to the discharge heater.

This embodiment adopts a method of determining the driving voltage $V_{OP}$ by employing the driving voltage $V_R$ actually applied to the discharge heater in order to reduce the measurement error in setting the driving voltage applied to the discharge heater by the use of the dummy heater. That is, in this embodiment, the voltage $V_{OB}$ is applied to a Wheatstone bridge as the driving voltage $V_R$ is variable at stages under the control of the recording apparatus main device.

Figure 16:
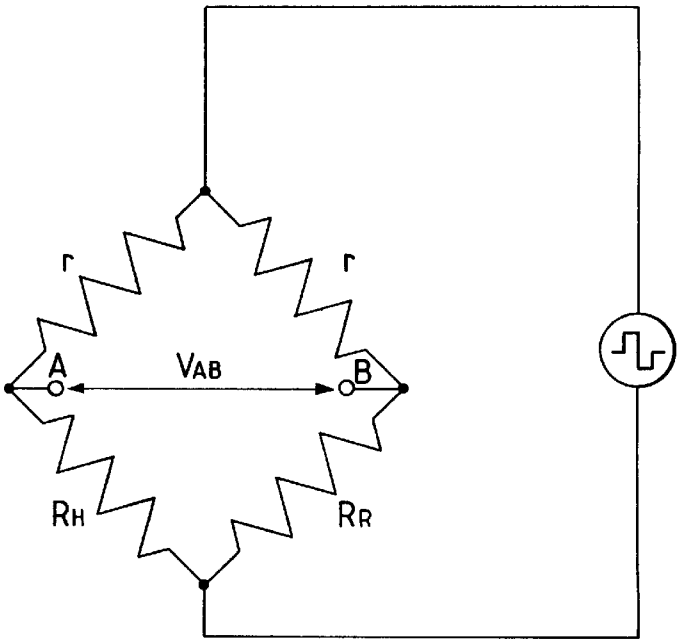
FIG. 16 is a diagram for explaining another embodiment in which the resistance for the discharge heater is measured and the driving voltage for the recording head is set.

In this embodiment, the driving voltage $V_{OP}$ is determined by a circuit having a Wheatstone bridge structure as shown in a circuit diagram of FIG. 16. This Wheatstone bridge is comprised of two resistors having the same resistance r, a dummy heater (resistance $R_H$) and a reference resistor $R_R$. This reference resistor $R_R$ has a resistance $R_R$ as discharge heater optimal for the driving voltage $V_{OP}$, Next, a method of determining the driving voltage $V_{OP}$ actually applied to the recording head from among multiple driving voltages $V_R$ will be described below. The voltage $V_{AB}$ between terminals A and B is measured when the multiple driving voltages $V_R$ are applied to this circuit, and the voltage rank when the smallest measurement is taken is set as a driving voltage $V_{OP}$ to be applied to the recording head.

Since other constitution and method are the same as those in the previous embodiment, the previous embodiment will be quoted.

The second constitution will be described with reference to the drawings.

Figure 17:
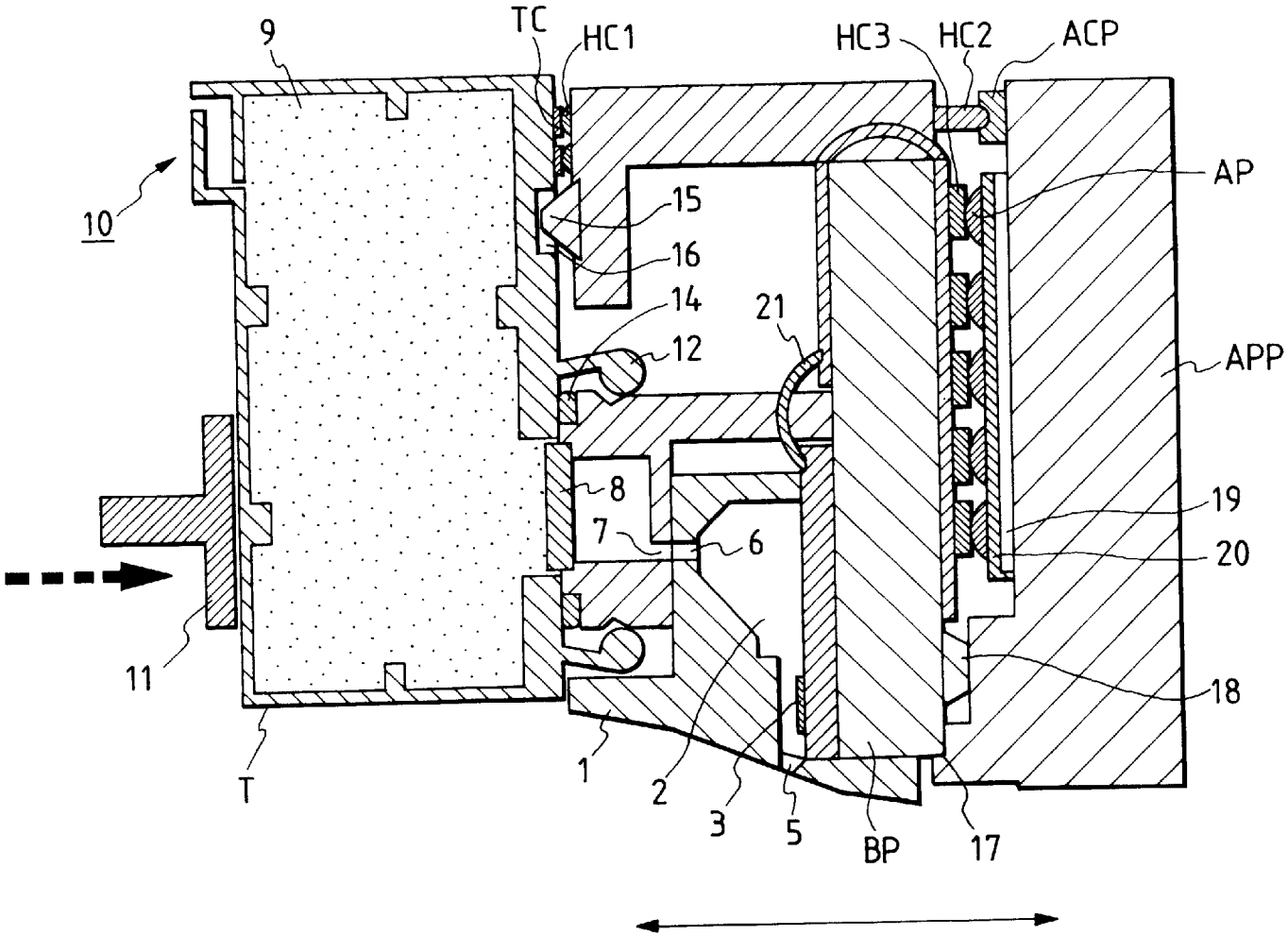
FIG. 17 is a cross-sectional view of essential parts including a carriage with a recording chip mounted for use in carrying out the present invention.

FIG. 17 is a cross-sectional view of essential parts including a carriage with a recording head mounted for use in carrying out the present invention. A feature of the constitution in this figure is that there are provided an electrical connection for discriminating new attachment of ink tank T upon attaching ink tank T and recording chip, and a connection for enabling an electric signal to be supplied to control unit of the apparatus upon attaching recording chip to the carriage. Other constitutions include a positioning mechanism, a disconnecting mechanism, and an atmosphere communicating portion which can be changed in design.

In the embodiment as shown in FIG. 17, the ink tank T comprises internally a urethane sponge 9 of continuous fine porous material which is ink absorbent, an elastic engaging member 12 located outside an ink supply port which is elastically contacted under pressure against a recording chip as an ink supply portion, and an atmosphere communicating portion 10 of bent shape for communicating the inside to the atmosphere at an end portion opposite to the ink supply portion. This basic constitution has been disclosed in Japanese Laid-Open Patent Application No. 3-175051.

In this constitution, the tank has a capacity which equally divides the amount of ink usable for a life of recording chip, unlike the above known constitution, whereby the carriage failure is reduced, and the compactization of the apparatus is accomplished. Further, the ink tank T has an electrical contact TC for new attachment at its end portion which enables the electrical connection to be made upon connecting with the recording chip.

The recording chip to which this ink tank T is attached has been disclosed in the same basic constitution in Japanese Laid-Open Patent Application No. 3-175051. Specifically, it comprises a ceiling plate 1 having integrally an orifice plate and an ink channel constructing member, an ink supply channel forming member 7 having a filter 8, a silicone plate 4 having electrothermal converters 3, and a base plate BP having a plate 4 mounted. The ceiling plate 1 comprises a plurality of discharge ports 5, ink channels communicating with respective discharge ports 5, and a common liquid chamber 2 communicating with the ink channels, with an opening portion of the common liquid chamber 2 molded, and the plurality of discharge ports 5 being post-treated by an excimer laser. The base plate BP makes a predetermined engagement with head positioning members 17, 18 of carriage APP to assure a high precision of positioning the discharge portion of recording head with respect to the recording sheet. The ink supply channel forming member 7 has a filter 8 and an O-ring 14 at the junction with the ink tank T, with which the stabilization of ink supply state can be accomplished by preventing the leakage of ink in when connecting or disconnecting the ink tank.

This recording chip has a further constitution different from the above known one. That is, the filter 8 slightly projects outward from the supply channel forming member 7 to contact against the sponge 9 within the ink tank T, whereby the ink is stably supplied from the sponge 9. Accordingly, when the ink tank is disconnected, a contact portion of the sponge 9 with the filter is inflated, so that the ink remaining on the surface of filter 8 can be absorbed into the tank, and at the same time ink remaining within the ink tank is prevented from leaking therefrom. Electrical contacts AP which are electric signal supply portion from the apparatus side to the silicone plate 4 connect elastically to flexible electrical contacts HC3 U-shaped on the side of the base plate BP opposite the silicone plate 4, to thereby drive the electrothermal converters 3 via the electrical connection of wire bonding 21. Therefore, the base plate BP itself can be smaller in size than conventionally. The recording chip has a frame on which the operator can touch by hand, for the purpose of compactization and due to wiring concentration, on this frame are formed electrical contacts HC1 connecting to electrical contacts TC of ink tank, and a convex connecting portion 15 (corresponding to a tank concave portion 16) between ink tank and recording chip in their neighborhood, thereby securing the stable electrical connecting state. This frame has a pin HC2 connecting to a microswitch ACP of carriage APP on its opposite side, whereby a signal discriminating the presence of recording chip or the new attachment is supplied to the apparatus.

11 is a pressure means for pressing the ink tank T in a direction of the arrow to stabilize the connection with the ink supply portion. This pressure means may be any one of well-known two-member connecting means.

(Variation in Discharge Characteristics)

Figure 18:
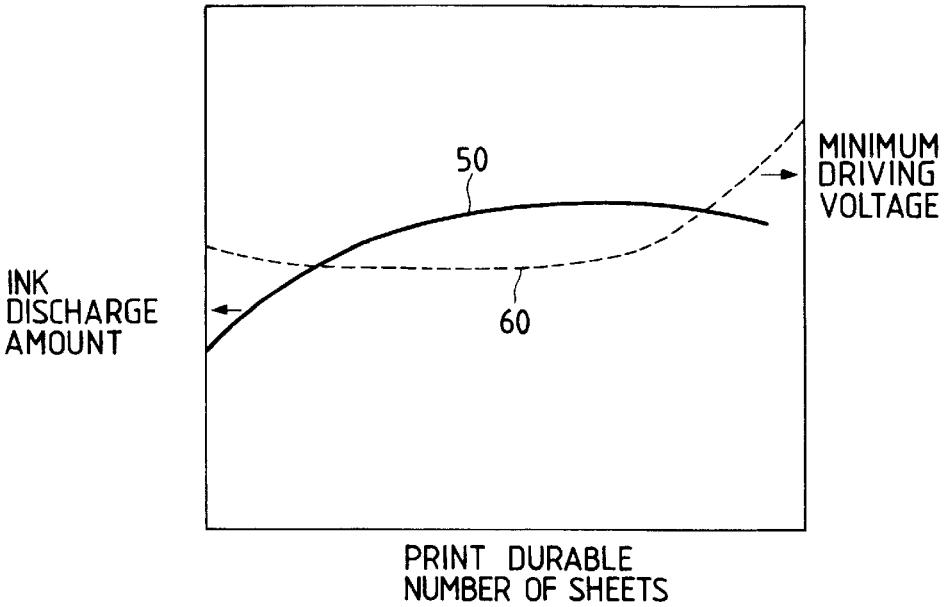
FIG. 18 shows how the ink discharge amount and the minimum driving voltage change when durably printed with one recording chip.

Now, the variation in the recording conditions for the ink jet recording head which is a technical problem of the present invention will be described with reference to FIG. 18. FIG. 18 shows the change in ink discharge amount and minimum driving voltage when print durability is tested for one recording head with the electrothermal converter. This figure shows the change of in the ink discharge amount when recording under certain driving conditions to its recording limit while continuing to supply the ink, by the solid line 50, and the voltage of minimum driving energy (thereinafter referred to as minimum driving voltage $V_{sh}$) necessary for discharging the ink at each recording time to obtain the discharge amount as indicated by the solid line, by the broken line 60.

As can be seen from the solid line 50, the ink discharge amount is minimum at the start of recording, then increasing greatly in the former half period which is about half of durability period, increasing gradually, and decreasing slightly. Normal commercially available products are pretreated to obtain the minimum discharge amount of FIG. 18 to meet the discharge amount at the initial time, but are not treated to cope with the change in ink discharge amount.

If the initial minimum discharge amount is raised to stabilize the ink discharge amount under fixed driving conditions with this change, the life of the recording head is shortened greatly. Examining this ink discharge amount at each time, it can be found as seen from the broken line 60, that the minimum driving voltage $V_{sh}$ which is obtained by varying the pulse voltage having a certain driving time decreases gradually from the initial time of recording, and rapidly increases up to higher voltage while the ink discharge amount is dropping. In this figure, the reason that the solid line 50 is broken halfway for the print durable number of sheets is that the dischargeable amount at a constant voltage above the minimum driving voltage $V_{sh}$ is exceeded.

The behavior of the ink jet recording head as shown in FIG. 18 can be considered as follows. Heat generating elements or ink channels used for ink jet recording chips have low affinity with the ink at the early time of recording to be poor in the heat transfer efficiency to the ink or copying ability. Since this affinity is gradually improved due to the heat of print durability and with the passage of time, the heat transfer efficiency becomes better to make the formation of bubbles stable, so that the ink discharge amount increases. If the print durable number is further increased, impurities in the ink are gradually deposited on the surface of heat generating element, and so-called burnt deposits occur, so that the heat transfer efficiency to the ink is lowered, and the ink discharge amount decreases. Since the minimum driving voltage for driving the heater necessary for the ink discharge increases at the same time, stable discharge characteristics can not be obtained within the life of recording head, or any discharge is not enabled, when driving at fixed voltage. Thus, in order to retain stable discharge performances for a long term in the ink jet recording head to have the longer life of recording head, it will be understood that it is effective to change the driving conditions of the head in the progress of print durability to suppress these changes in head discharge characteristics.

The present invention, which adopts a recording chip/ink tank separation-type head configuration, allows less wasteful recording to be accomplished by changing the driving conditions of head in accordance with the number of times that the ink tank has been exchanged for one recording chip, noting that the variation of recording characteristics can be relatively reduced for the exchange number by distributing the supply ink amount usable in the print durability to the exchange ink tanks, and the change of ink discharge amount is substantially proportional to the number of ink tanks exchanges.

(Overview of Temperature Control)

A specific example of temperature control applied to the following embodiments is such that an environmental temperature sensor for measuring the environmental temperature is provided on the main device side to estimate and predict the variation in ink temperature for the discharge portion from the past to current time and to the future by calculating the ink discharge energy and the supply energy to a sub-heater for retaining temperature for the recording head, so that the discharge is made stable in accordance with the ink temperature. This is to estimate and predict the variation in ink temperature for the discharge portion from the evaluation relying on a temperature variation table in which the making energies substantially relating to the heat time constant of the discharge portion including the recording head and the ink and the ink temperature are precalculated from the past to the future.

Figure 19:
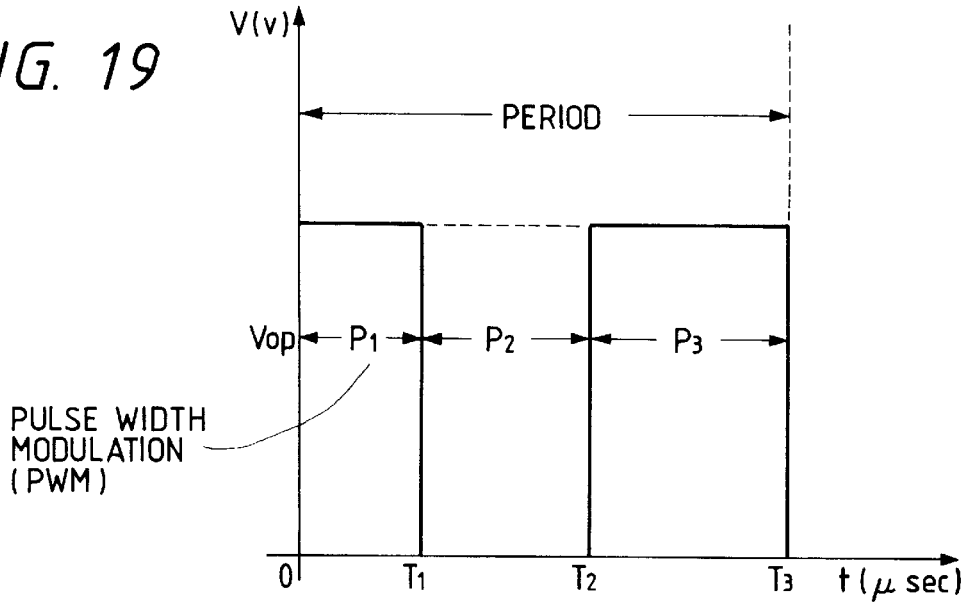
FIG. 19 is a view for explaining the division pulse relating to an embodiment as will be described later.

The temperature control using the driving pulse as shown in FIG. 19 is also applicable to the present invention. FIG. 19 is a graph for explaining the division pulse concerning the embodiments as will be described later. In the same figure, $V_{op}$ is the driving voltage, P1 is the pulse width of the first pulse (thereinafter referred to as pre-pulse) for multi-divided heat pulse, P2 is the interval time, and P3 is the pulse width of the second pulse (thereinafter referred to as main pulse). T1, T2 and T3 indicate the time for determining P1, P2 and P3, respectively. The driving voltage $V_{op}$ is one of the electric energies necessary for the electrothermal converter, to which this voltage is applied, to generate heat energy in the ink within ink liquid channels formed by a heater board and a ceiling plate. Its value is determined by the area of the electrothermal converter, resistance, film structure, and liquid channel structure of recording head.

This PWM discharge control is also called a pre-pulse width modulation driving method, in which pulses are supplied in sequence in the pulse width of P1, P2 and P3 when discharging one ink droplet, while the pre-pulse width is modulated in accordance with the ink temperature. The pre-pulse is one principally for controlling the ink temperature within the liquid channels, and plays an important role for the control of discharge amount in this embodiment. It is preferable that this pre-heat-pulse width is set at a value that does not give rise to foaming phenomenon in the ink due to the heat energy generated by the electrothermal converter to which pulses are applied. The interval time is to allow the time for passing the pre-pulse energy to the ink within the ink liquid channels and prevents excessive temperature rise. The main pulse is to produce bubbles in the ink within liquid channels, and discharge the ink through discharge ports, its width P3 being preferably determined by the area of the electrothermal converter, resistance, film structure, and ink liquid channel structure of recording head.

Figure 20:
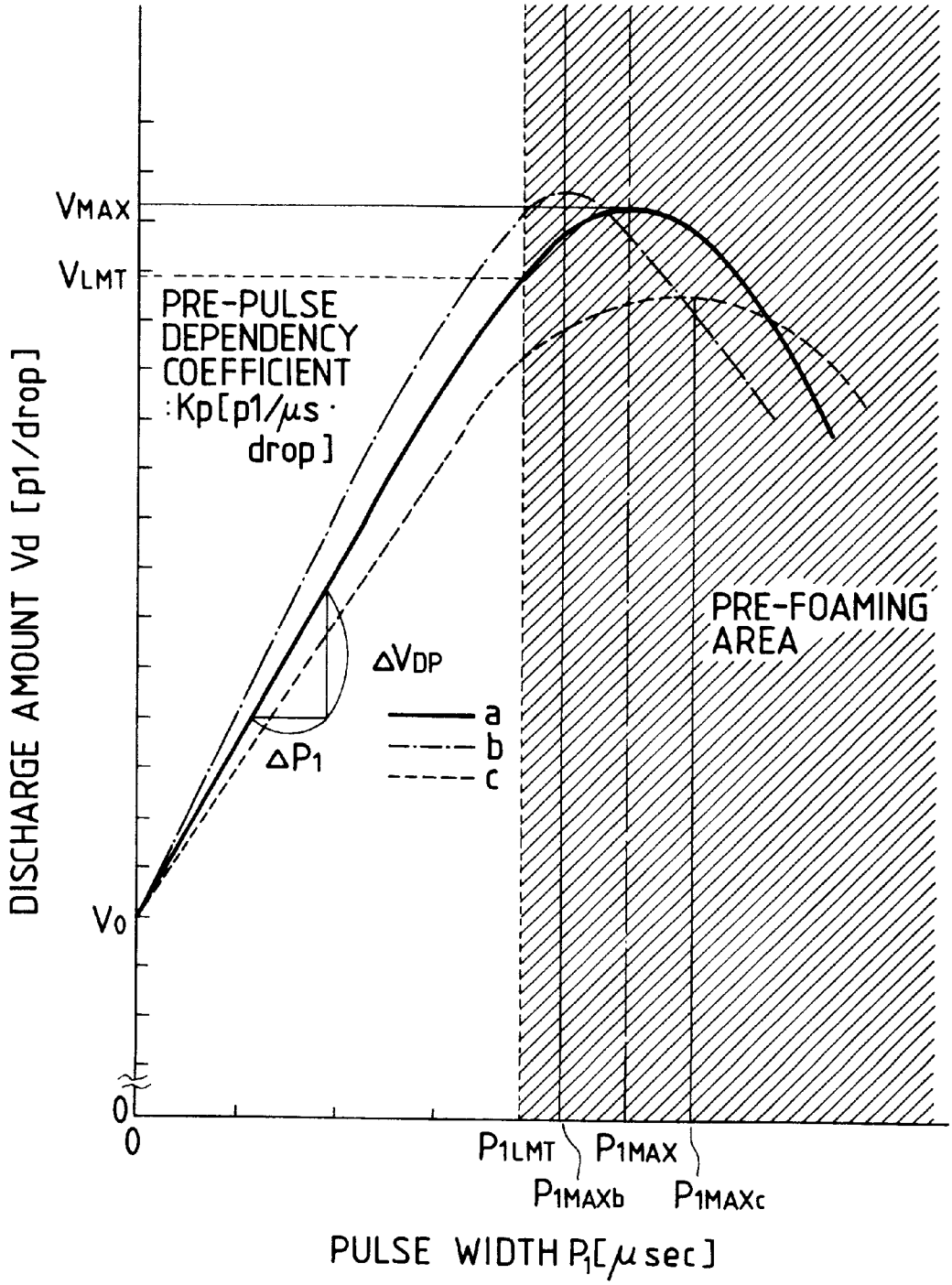
FIG. 20 is a view for explaining the relation between discharge amount $V_d$[p1/drop] and pre-pulse width P1 [$\mu$sec] as shown in FIG. 19.

The action of pre-pulse in the ink jet recording head as shown in FIG. 17, for example, will be described below. When the main pulse width is P3=4.114 [μsec] under the fixed driving voltage $V_{op}$ of 18.0 (V), and the pre-pulse width P1 is varied in a range from 0 to 3.000 [μsec], the relation between discharge amount Vd [p1/drop] and pre-pulse width P1 [μsec] is obtained as shown in FIG. 20. The same figure is a diagram showing the pre-pulse width dependency of the discharge amount, and in the figure, V0 indicates the discharge amount when P1=0[μsec], which value is determined by the head structure as shown in FIG. 5. Hence, in this embodiment, V0 was V0=18.0 [p1/drop] when the environment temperature was TR=25° C.

As can be seen from curve a in FIG. 20, the discharge amount Vd increases linearly when the pre-pulse width P1 increases from 0 to $P1_{LMT}$, with its linearity lost beyond $P1_{LMT}$, and is saturated to the maximum at the pulse width $P1_{MAX}$. In this way, the range of P1 less than pulse width $P1_{LMT}$ in which the discharge amount Vd linearly changes with respect to the pulse width P1 is effective to control the discharge amount readily by varying the pulse width P1. Hence, in this embodiment, as indicated by the curve a, $P1_{LMT}$=187 (μs), and the discharge amount at this time was $V_{LMT}$=24.0 [p1/drop]. The pulse width $P1_{MAX}$ at which the discharge amount Vd was saturated was $P1_{MAX}$=2.1 [μs], with the discharge amount $V_{MAX}$=25.5 [p1/drop]. When the pulse width is larger than $P1_{MAX}$, the discharge amount Vd is smaller than $V_{MAX}$. This phenomenon is considered due to the fact that if a pre-pulse having the pulse width in the above range is applied, a minute bubble (in a state immediately before film boiling) is produced on the electrothermal converter, and if the next main pulse is applied before this bubble disappears, the minute bubble disturbs bubbling by the main pulse, thereby reducing the discharge amount. This area is called a pre-foaming area, in which range the control of discharge amount via the pre-pulse is difficult. The slope of the line representing the relation between the discharge amount and the pulse width in the range from P1=0 to $P1_{LMT}$ [μs] as shown in FIG. 13 is defined as a pre-pulse dependency coefficient, which is expressed as $$K_p = \Delta V_{dp} / \Delta P1 \ [p1/\mu sec \cdot drop]$$

This coefficient $K_p$ is determined depending on the head structure, drive conditions, and ink material, irrespective of the temperature. That is, in FIG. 20, curves b and c represent the relation for other recording heads, and it can be found that the discharge characteristics will change for different recording head. In this way, since the upper limit $P1_{LMT}$ of pre-pulse P1 will vary for different recording heads, the discharge amount control is made by defining the upper limit $P1_{LMT}$ for each recording head. Hence, for the recording head and the ink as indicated by the curve a in this embodiment, $K_p$=3.209 [p1/μsec·drop].

Figure 21:
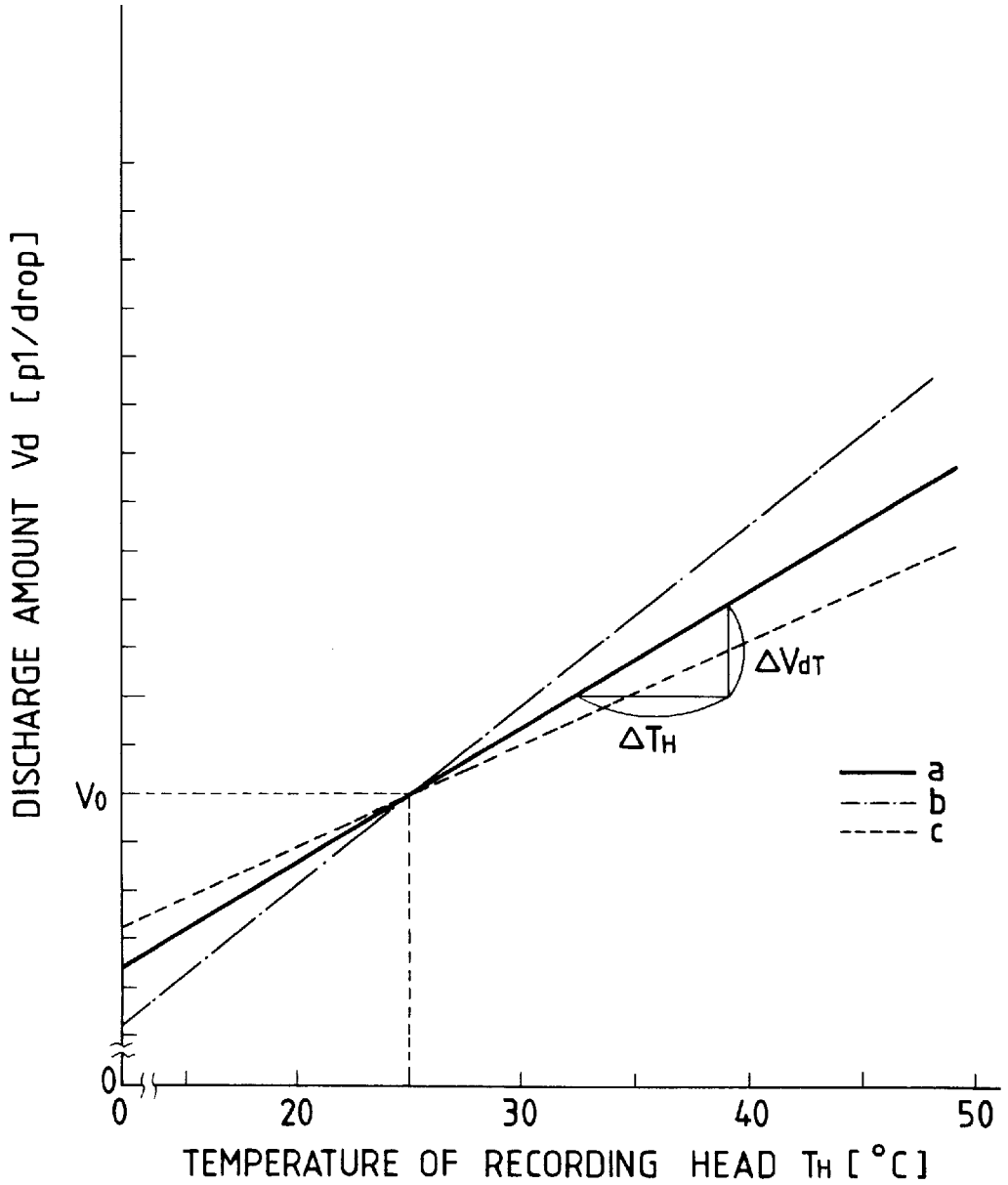
FIG. 21 is a graph representing a control example for the discharge amount when the recording chip is driven at division pulse.

On the other hand, other factors for determining the discharge amount of the ink jet recording head include the ink temperature of discharge portion (for which the temperature of the recording head may be substituted). FIG. 21 is a graph representing the temperature dependency of the discharge amount. As shown by curve a in the same figure, the discharge amount Vd linearly increases when the recording head temperature TH (which is equal to the ink temperature of discharge portion owing to static temperature characteristics in this case) increases. The slope of this line is defined as a temperature dependency coefficient, which is expressed as $$KT = \Delta V_{dT} / \Delta TH \ [p1/^\circ C. \cdot drop]$$

This coefficient KT is determined depending on the head structure and ink material, irrespective of the drive conditions. In FIG. 21, curves b and c represent the relation for other recording heads. Hence, in the recording head of this embodiment, KT=0.3 [p1/° C.·drop]. In FIG. 21, $V_0$ indicates the minimum discharge amount, and the reference temperature $T_0$ for temperature regulation at this time is the minimum retained temperature of the recording head, beyond which temperature the discharge amount will considerably increase in proportion to the temperature. This temperature change relies on a normal temperature regulating method and a PWM control method to heat and insulate the recording head at low ink temperatures of the discharge portion. Usually, the retained temperature is set at a higher value (e.g., 35 to 40° C.) than the normal environmental temperature. Since fundamentally it is sufficient to meet this temperature condition only when the ink is discharged, it is preferred that, as previously described, the discharge amount control is made with a smaller pre-pulse than in the pre-foaming area, and the temperature range being PWM controllable is restricted to some extent, whereby owing to the temperature self-elevation of the recording head, it is easier to accomplish stable discharge by setting higher retained temperature.

In the following, specific embodiments will be described with reference to flowcharts of FIGS. 22 to 24, and the principle views of FIGS. 25 and 26.

(Third Embodiment)

An embodiment in which the present invention is applied to the discharge amount control for a monochromatic printer will be described below. In the monochromatic printer, it is significantly important to prevent the degradation of print quality due to bleeding or feathering while meeting the permissible print density, and therefore it is necessary to suppress changes in the discharge amount while keeping the minimum discharge amount of the ink.

Figure 25:
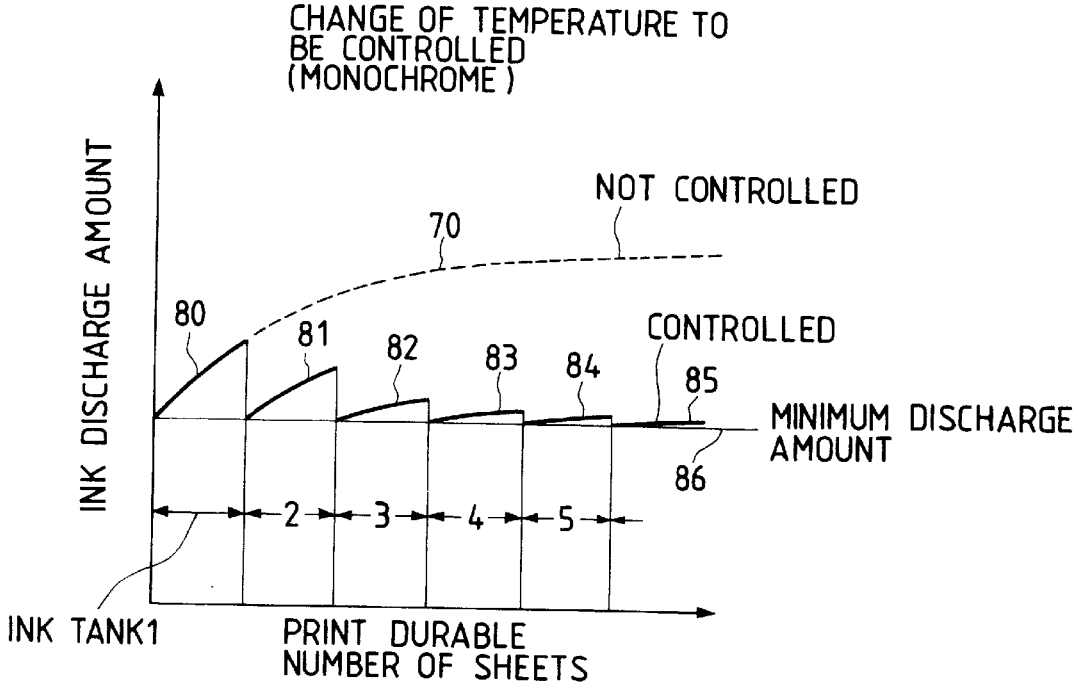
FIG. 25 is a principle view for making the correction to assure the minimum discharge amount and suppress variations in the discharge amount.

FIG. 25 is a principle diagram for compensation when suppressing the change of discharge amount while assuring the minimum discharge amount. In FIG. 25, the broken line 70 represents the change of ink discharge amount under the fixed driving conditions without the use of this embodiment. This embodiment adopts a method of varying the recording head temperature setting for temperature adjustment as means for controlling the discharge amount. As can be clear from the description in FIG. 21, the recording head temperature a nd the ink discharge amount are substantially in proportional relation, whereby in this embodiment the reference set value of temperature to be controlled is changed to lower the set temperature every time the exchange number (number of ink tank changes) increases in sequence, such as first ink tank, second, third, . . . . In FIG. 25, it is presumed that five ink tanks can be used for one recording chip. The discharge amount control as shown in FIG. 25 can be implemented by changing the recording head temperature setting for temperature adjustment in exchanging the ink tank.

Specifically, the ink tank I which is first applied to recording chip performs substantially the same ink discharge as with the conventional ink discharge amount curve. As the ink tank 1 is applied to the recording chip, the drive condition for the recording head is that the reference temperature for temperature control is set at a first set temperature T1 (e.g., 40° C.). Then, if the ink tank 1 is consumed, and ink tank 2 is attached onto the same recording chip, in place of the ink tank 1, the driving condition for the recording head is that the reference temperature for temperature control is changed to a second set temperature T2 (e.g., 38° C.) as the lower limit. Thereby, during recording period of the ink tank 2, the recording is relatively more efficient than conventionally, with less recording density change, whereby excellent images can be recorded. Likewise, if ink tank 3 is attached, the reference temperature is changed to a fourth set temperature T4 (e.g., 33° C.) as the lower limit, and if ink tank 5 is attached, it is changed to a fifth set temperature T5 (e.g., 30° C.). Thereby, a greater amount of ink can be used than the total amount of ink in one ink tank integral therewith attached to the recording chip, without causing the change of ink characteristic, so that the recording chip can form excellent recording images stably see a long term. Moreover, as can be seen from recording discharge amount variation curves 80 to 84 for each ink tank in FIG. 25, the minimum discharge amount (as indicated by the line 86) is satisfied for any of the ink tanks in this embodiment, whereby the difference from the integration value of the broken line 70 is apparent. Note that the number of ink tanks applicable to the recording chip is preferably from three to ten, and it is preferable that the frequency of exchange fall within an appropriate range. In the figure, a curve 85 represents the discharge amount of the sixth ink tank, with the sixth set temperature T6 being 28° C., for example, although the set temperature following the sixth one may be the same as the fifth set temperature T5. The change of the driving condition in the present invention is made for the initial conditions in one recording chip as above described, so that the higher efficiency of ink consumption can be accomplished.

Figure 22:
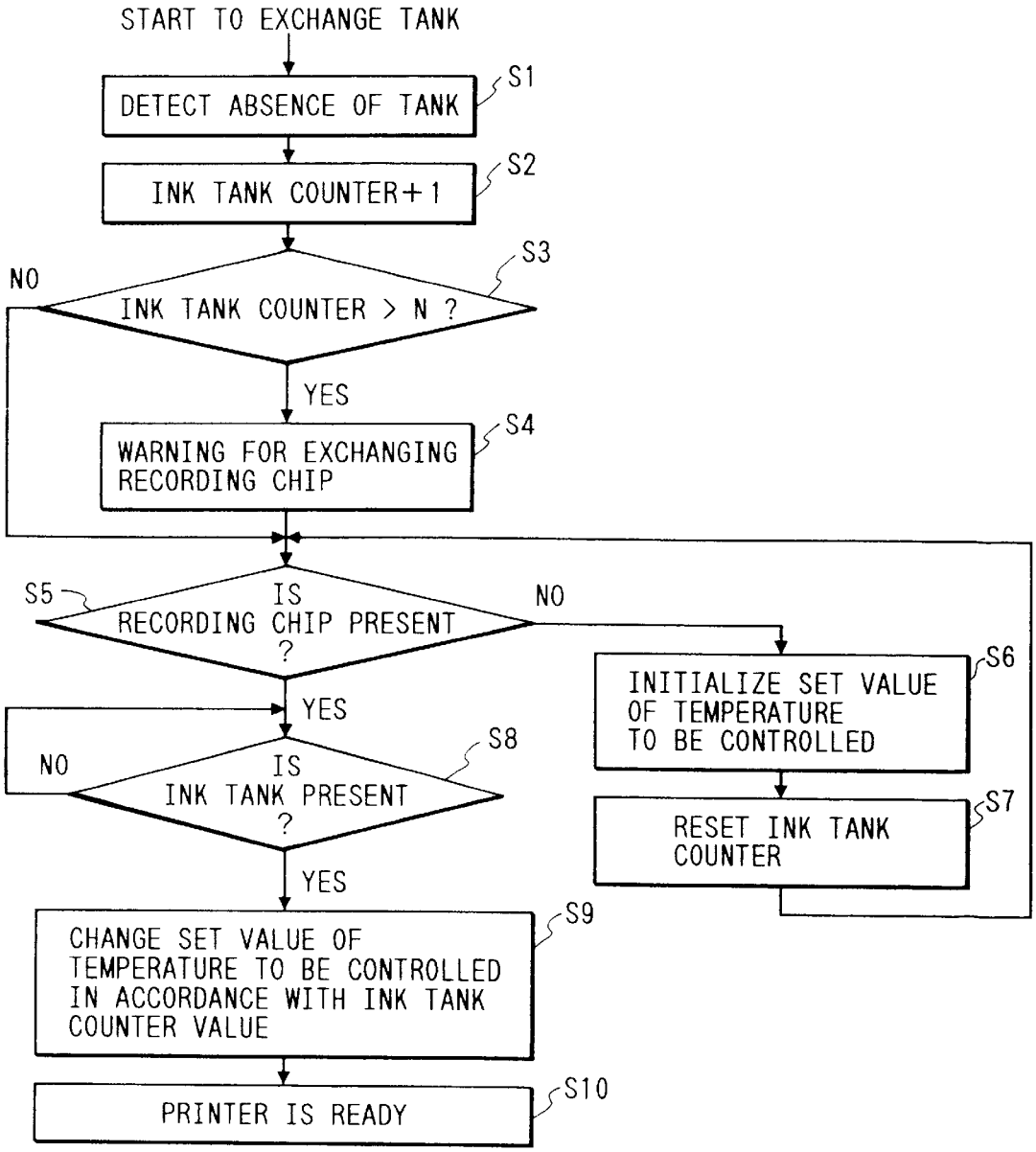
FIG. 22 is a flowchart for altering the set temperature for the temperature control in the present invention.

FIG. 22 shows an example of flowchart for use in changing the set value of temperature to be controlled as above described. This flowchart is applicable to a recording apparatus (see FIG. 17) having a mechanism which allows the user to take out the ink tank from the carriage when the ink for discharge is used up, and attach a new ink tank. The ink discharge is not recovered even after the recovery operation, the operator sets to the exchange operation of ink tank. At this time, if the ink tank attached is disengaged from the recording chip, the absence of the ink tank is detected at step S1, when the presence or absence of ink tank in the carriage is judged. Then, an ink tank counter is incremented by +1, and whether or not it exceeds the attachable ink tank number N for the recording chip is judged at step S2 before attaching a new ink tank. If the ink tank number N is exceeded at step S2, a warning for exchanging the recording chip itself is issued at step S4 to prompt the operator to exchange the recording chip. Thereby, if the recording chip is disengaged for the exchange from the apparatus, the presence of the recording chip is further judged at step S5, and the set value of the temperature to be controlled is initialized before attaching a new recording chip, that is, the recording condition with the new recording chip and the new ink tank is set at a first set temperature T1 at step S6, and the ink counter is set to 1 at step S7 which is a reset process for the ink counter. In this state, the apparatus waits for a new recording chip to be attached at step S5. If no warning for exchanging is made or the new recording chip is attached (warning is reset at this time) at step S5, the attachment of a new ink tank is judged at step S8. If the attachment of new ink tank is confirmed at this step, the set value of temperature to be controlled is changed in accordance with the ink tank counter value, for example, in the same method as shown in FIG. 7. Thereby, the preparation for ink tank and recording chip in the apparatus is completed, and the apparatus terminates the change of recording conditions. Thereafter, the predischarge or recovery for recording head is performed in accordance with desired conditions, as necessary, so that the printer is made ready (step S10).

This embodiment is preferred because it predicts a member to be attached and makes a preparation therefor before attaching the new recording chip and new ink tank, thereby eliminating the waiting time of the user.

(Fourth Embodiment)

An embodiment which is particularly effective when the present invention is applied to the discharge amount control of a color printer will be described below. In the color printer, color balance is particularly important, and therefore it is significantly important to suppress the change of ink discharge amount.

Figure 26:
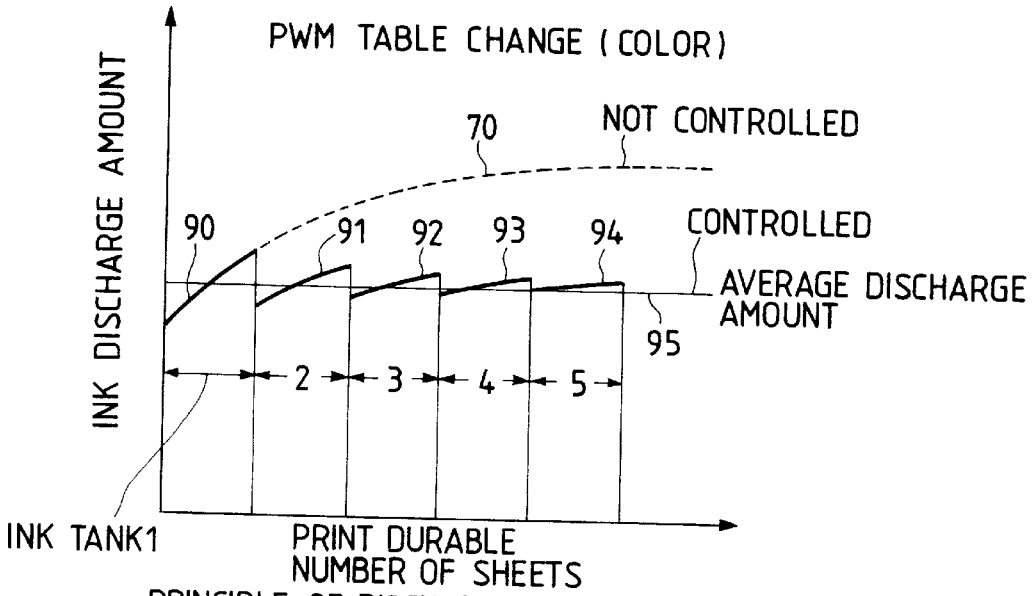
FIG. 26 is a principle view for making the correction to suppress variations in the discharge amount to the minimum.

FIG. 26 is a principle view for compensation in suppressing the change of discharge amount to the minimum. One means for such a discharge amount control is a method of changing the setting of driving pulse width for the recording head. Particularly effective method is a PWM control as previously described in FIG. 19, and the use of rectangular voltage pulses for use in the multipulse driving allows for the discharge amount control as shown in FIG. 26 at high precision.

Figure 23:
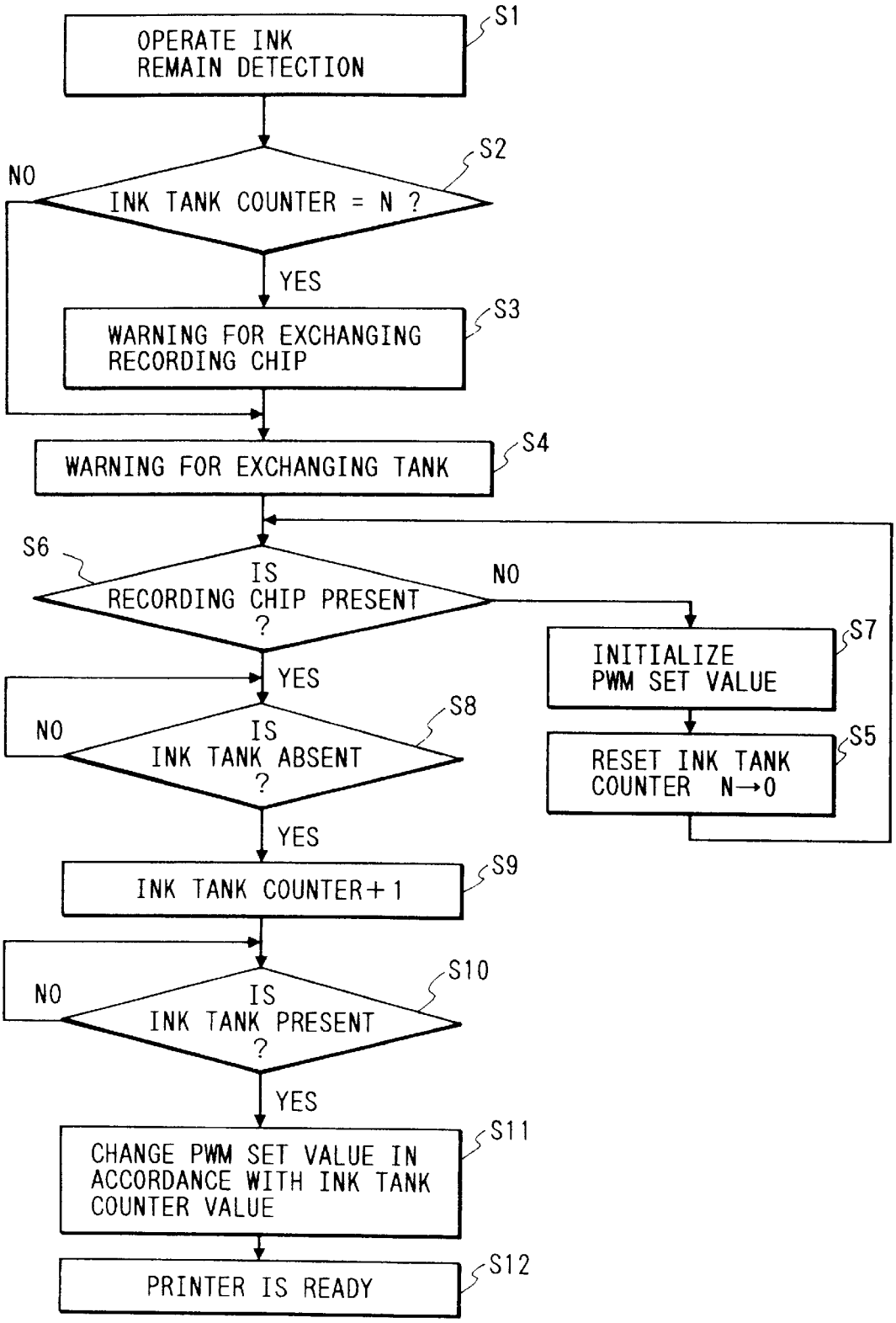
FIG. 23 is a flowchart for color recording in which the PWM control is performed by using a remain detecting mechanism of the present invention for the exchange of ink tank.

FIG. 23 shows an example of a flowchart for such control. This flowchart is concerned with a recording apparatus of the type of having an ink remaining detection mechanism for ink tank exchange in which no ink within the ink tank is detected beforehand, with a warning of exchanging ink tank issued to the user.

In FIG. 23, an ink remain detecting operation to determine the ink remaining within the ink tank (or recording chip) is periodically performed at step S1. If no ink remain is detected, whether or not the ink tank counter value is equal to an attachable ink tank number N for the recording chip in use is judged at step S2. If it is equal to the ink tank number N at step S2, a warning for exchanging the recording chip itself is issued at step S3 to prompt the user to exchange the recording chip. In either case, after step S2, a warning for exchanging the ink tank is issued at step S4 to prompt the user to attach a new ink tank. At step S6, if the recording chip has been disengaged from the carriage, the PWM set value is initialized before attaching a new recording chip to the apparatus, that is, the recording condition with the new recording chip and the new ink tank is set at a first set pulse width $P_1$1 at step S7, and the ink tank counter is set to 1 at step S5 which is a reset process for the ink counter. In this state, the apparatus waits for a new recording chip to be attached at step S6. If no warning for exchanging the recording chip is made or the new recording chip is attached (warning is reset at this time) at step S6, the detachment of a used ink tank is judged at step S8. This is to prevent the used ink tank from being reattached by utilizing the ink remain detection. Herein, only if the detachment is confirmed, the ink tank counter is incremented by +1 at step S9, and the apparatus waits for a new ink tank to be attached at step S10. If the attachment of a new ink tank is confirmed (warning is reset at this time), the N-th set pulse width $P_1N$ (N is a use order of ink tank, wherein the pulse width $P_1N$ decreases when N increases) is set in accordance with the ink tank counter at step S11. Thereby, even if a plurality of recording heads have the recording chip and/or the ink tank arbitrarily changed in consumption, the density balance of color recorded image can be suppressed within a stable range.

In this way, the preparation for ink tank and recording chip in the apparatus is completed, and the apparatus terminates the change of recording conditions. Thereafter, the predischarge or recovery for recording head is performed in accordance with desired conditions, as necessary, so that the printer is made ready (step S12).

With this embodiment having the multiple conditions applied, the present invention is particularly most suitable for the color recording, wit h the setting change f or the electrothermal converter at high precision being most suitably made with the PWM control.

(Fifth Embodiment)

Figure 28:
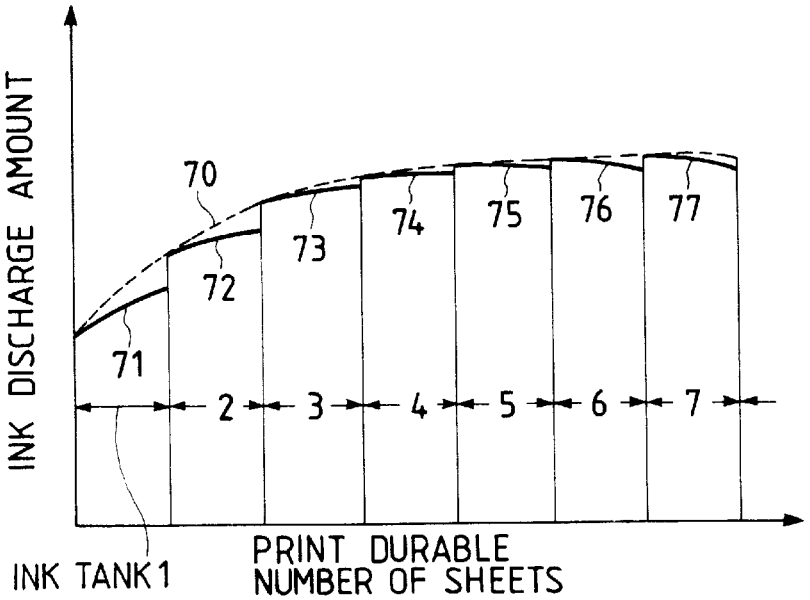
FIG. 28 is an explanation view when using an ink tank having an ink holding portion for generating a negative pressure within the ink tank.

An embodiment in which the present invention is applied to accomplish mainly the longer life of recording head for the monochrome printer will be described below. This is different from the stabilization of discharge amount as previously described, but effective as means for resolving the described problems. As described in FIG. 18, the ink jet recording head has its minimum driving voltage rising with print durable, it may be disenabled to make a discharge at some time under the condition of constant driving voltage, so that its life expires. By delaying this time, the longer life of recording head is allowed. FIG. 28 is a principle view for making the compensation for driving voltage to delay the discharge unstable/disenabled time by changing the driving voltage. This principle is not only applicable to electrothermal converters but also to electro-mechanical converters.

Figure 27:
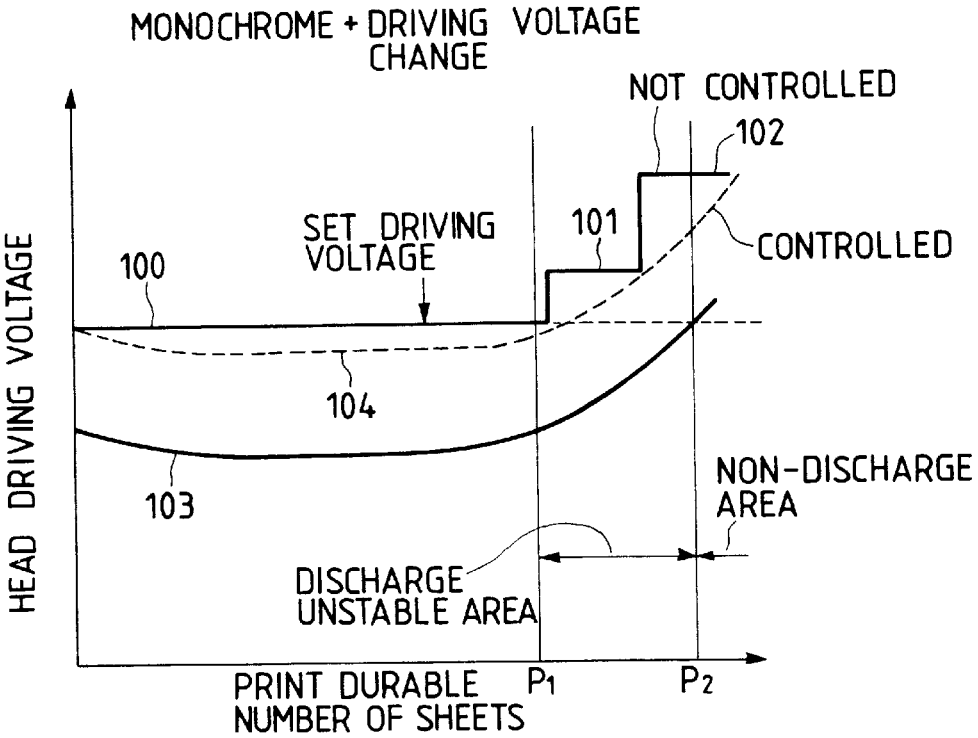
FIG. 27 is a principle view for making the driving voltage correction to delay the discharge unstable/disenabled period by changing the driving voltage.

In FIG. 27, $P_1$ is the upper recordable number of sheets in a recordable range as shown in FIG. 18, and $P_2$ is the life time of recording head. The solid lines 100, 101 and 102 represent how to change the driving voltage in the embodiment of the present invention to show that the recording is enabled for a range from the number $P_1$ in discharge unstable area to life time $P_2$, while the broken line 104 represents the minimum driving voltage $V_{sh}$ in FIG. 18. The solid line 103 represents roughly the change of ink discharge amount in this embodiment.

Usually, the constant driving is performed with the driving voltage of recording head set at 1.2 times the minimum driving voltage $V_{sh}$, but in this embodiment, considering that the initial driving voltage is effectively utilized, the initial minimum driving voltage $V_{sh}$ is applied for the initial recording to lengthen the life of recording head while stabilizing the ink discharge amount. In the discharge unstable area and beyond, the voltage (solid lines 101, 102)

exceeding the minimum driving voltage $V_{sh}$ in that area is supplied by raising it stepwise. Thereby, it will be understood that, as indicated by the solid line 103, the recording is enabled stably in the discharge unstable area possibly giving rise to a recording failure as well as a range of the life time $P_2$ and beyond, even if the discharge amount is more or less increased, whereby the life of recording head can be lengthened.

Figure 24:
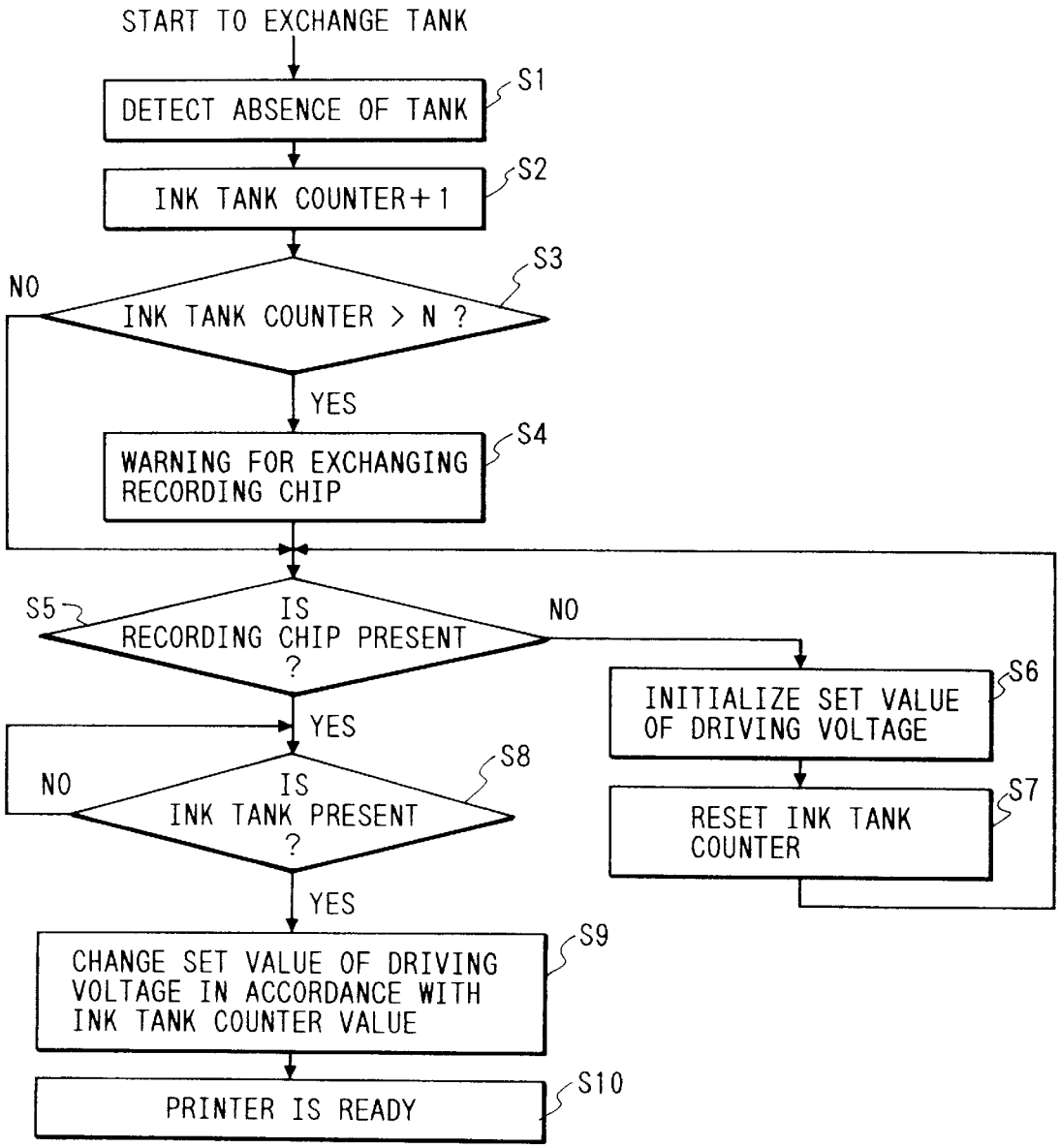
FIG. 24 is a flowchart for raising stepwise and supplying the voltage (solid lines 101, 102) exceeding the minimum driving voltage $V_{sh}$ of the present invention.

FIG. 24 shows an example of flowchart in this embodiment. This flowchart is the same as that of FIG. 22, except for the execution contents at steps S6 and S9, and therefore the different portion is only discussed. In this embodiment, the ink tank use number for one recording chip is greater than in the previous embodiments, in which N increases from 5 to 7. This embodiment is to supply a voltage as indicated by the solid line 101, 102 for the recording conditions of N=6, 7, respectively. The present invention includes making a change for a subgroup of ink tanks using such recording conditions. Accordingly, at step S6 in FIG. 24, the recording condition is changed to the minimum driving voltage $V_{sh}$ for the initial recording, and at step S9, the voltage as indicated by the solid line 101, 102 when N is equal to 6 or 7, or the minimum driving voltage $V_{sh}$ for the initial recording when N is equal to or less than 5, is selected for recording.

In this way, the supply driving voltage effectively improves the ink consumption efficiency, while lengthening the life of the recording chip.

FIG. 27 can be utilized to explain the contents of another embodiment. That is, this is an easier-to-understand embodiment in which to accomplish the longer life of recording head, the ink discharge amount is increased in the latter half of ink supply by changing the driving condition. In the following, the points different from those as previously described will be only described. In the description of this embodiment, it is supposed that the solid line 103 as previously described represents the minimum driving voltage $V_{sh}$ in FIG. 18, and the broken line represents the proper driving voltage $V_{op}$ which is as large as 1.2 times the minimum driving voltage $V_{sh}$ for the stable discharge.

Therefore, the stable discharge at constant voltage is disenabled, as indicated by the solid line 103, in the discharge unstable area of recording chip and beyond, as previously described, but in this embodiment, the proper driving voltage $V_{op}$ exceeding the solid line 103 is supplied, so that the discharge is made stable, and the stable recording period can be extended. Further, for the term beyond the life time $P_2$, the proper driving voltage $V_{op}$ exceeding the minimum driving voltage $V_{sh}$ as indicated by the solid line 103 is supplied, so that the recording head is securely enabled for the discharge, substantially lengthening its life, and the remaining ink can be effectively utilized for the recording. In this case, since the proper driving voltage $V_{op}$ is a curve, the solid lines 101, 102, 103 in FIG. 27 are used to change the recording condition stepwise, but curvilinearly or as indicated in FIG. 27, the driving condition can be changed in accordance with the curve or a combination thereof so as to exceed the broken line 104. The flowchart for this embodiment may be the same as that in FIG. 24.

(Other Embodiment)

The present invention covers all the embodiments for various changes of the driving conditions, which can be readily contemplated from the above description, and based the concepts of the invention as described. For example, an embodiment adopting a plurality of previously-described embodiments allows for further stabilization and the longer life, and the following method can be cited.

In FIG. 28, when an ink tank having an ink holding portion producing a negative pressure, such as a sponge 9 as described in FIG. 17, within the ink tank is used, the negative pressure is differently produced near the start and end of use for each ink tank, and therefore the effect of equalizing the average value of ink discharge amounts is utilized. In this case, a further preferred configuration of the present invention results, but when the ink discharge amount abruptly decreases near the end of use due to negative pressure changes, stabilization can be further obtained by altering each compensation as above described to be made during the use of one ink tank, so that the invention becomes more preferable. In any case, it is more practical to further modify the above-described change of recording conditions depending on the ink supply number from the ink tank to the recording chip, in accordance with the ink amount within the ink tank of the present invention. The above embodiment supposes the recording head exchange type, but the present invention is also effective to for the permanent-type apparatus which can use the recording head for quite a long term.

(Discriminating Method of Recording Head)

Here, a configuration for detecting or discriminating a new attachment state of the ink tank of recording head and the recording chip will be described. Since they are not usually taken out of the printer if the recording head causes no recording failure, a method of discriminating reattachment as a new one may be valid. However, as they may be detached accidentally during operation, a configuration capable of discriminating appropriately such detachment will be described.

By prompting the operator to turn on a reset key for resetting the recording for each of the warnings for exchanging as above described, a new ink tank or recording chip can be discriminated, and upon this on signal, the ink tank counter or the recording chip may be initialized. This configuration is particularly suitable for the ink supply of the type of refilling the ink while reusing the ink. As another method, an electrical resistor which will break down due to a number of energizations is provided on the recording chip or ink tank, whereby using this resistor, a new recording chip or ink tank is ascertained, and after ascertaining, this resistor is caused to break down by energizing a number of times so that recording chip or ink tank during use can be ascertained. Further, a lock mechanism for preventing the release unless a warning for exchanging is issued may be used.

Figure 13:
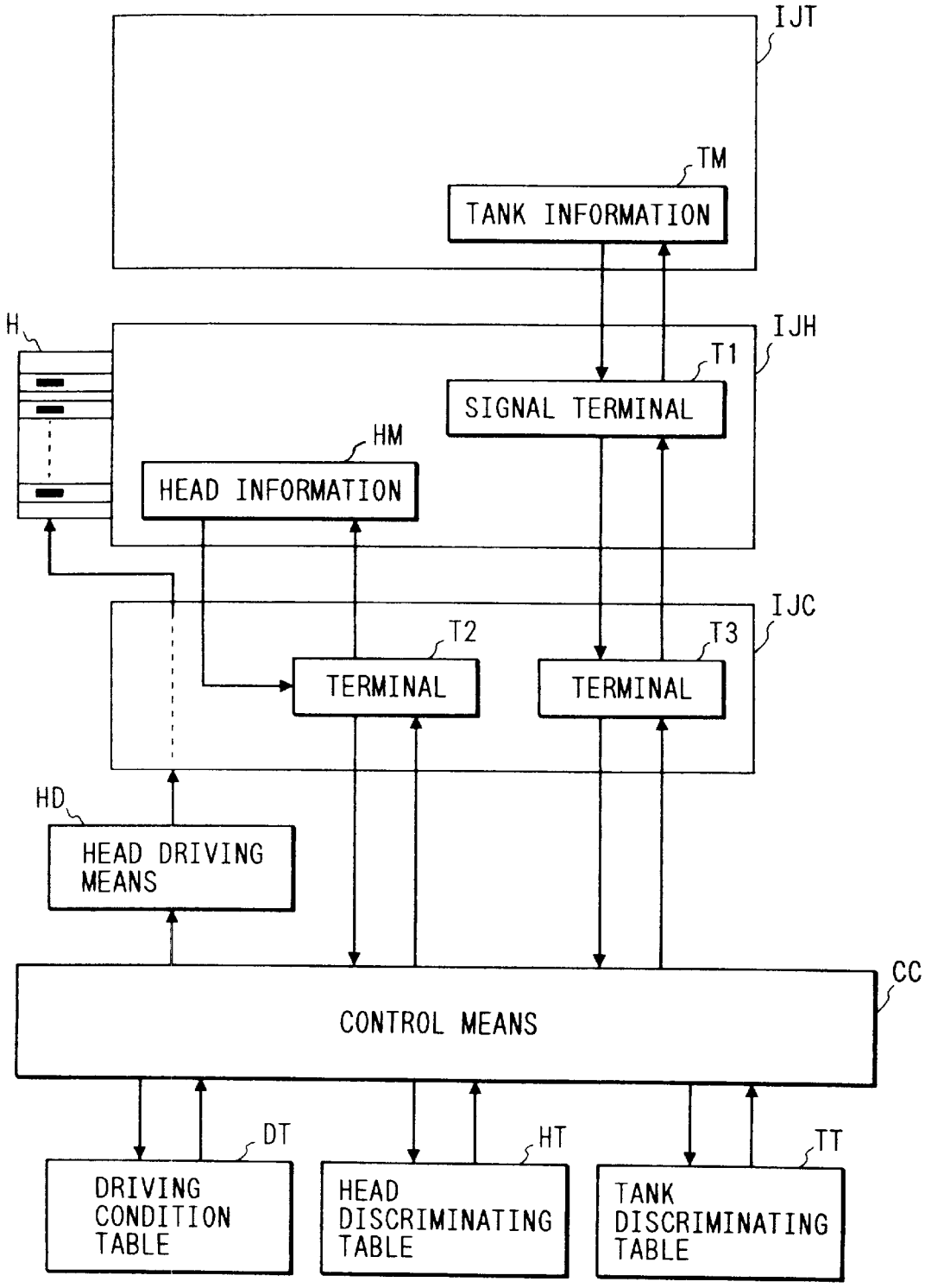
FIG. 13 is a schematic diagram of the information processing apparatus using the ink jet recording apparatus according to the present invention.

In particular, an effective configuration is shown in FIG. 13. In FIG. 13, a recording chip IJH and an ink tank IJT are caused to carry respective information, which is then properly discriminated through individual electric transmission passage to change the drive conditions properly. Tank information TM has the order of attaching on the recording chip IJH as data with electrical signal or different arrangement of electrical contacts, or resistance. This tank information TM is preferably a ROM having the driving conditions themselves. The tank information TM is passed via a signal terminal T1 of recording chip IJH and a terminal T3 of carriage IJC to control means CC. And the control means CC discriminates whether or not there is any ink tank IJT attached to the recording chip IJH, and the applying order of the ink tank attached thereto, based on a discriminating table stored in a tank discriminating table TT. The control means CC can determine the aptitude by comparing the ink tank information transmitted with the selected information only if the information of ink tank to be attached in exchanging the ink tank is selected. If the ink tank information transmitted is proper, the control means CC adopts its information.

Head information HM including the driving conditions on manufacture provided in the recording chip IJH and the information as to whether the recording chip is in use or new (in which preferably the used ink tank number is writable into writable memory) is passed via a terminal T2 of carriage IJC to control means CC. And the control means CC discriminates the information provided in the recording chip IJH, based on a discriminating table stored in a head discriminating table HT. The control means CC selects the optimal driving conditions for the electrothermal converter of the recording chip in use from a driving condition table DT, based on the ink tank information and the head information. And the control means VV controls head driving means HD to drive the recording chip IJT under the optimal driving conditions selected.

In this way, various type of discriminations can be applied in each portion of the present invention, and the present invention covers all the configurations as above described. (Others)

The present invention brings about excellent effects particularly in a recording head or a recording device comprising means for generating heat energy as the energy for use in discharging the ink, and causing the state change of ink with the heat energy among the various ink jet recording systems. With such a method, the higher density and higher resolution of recording can be accomplished.

As to representative principle of discharging ink droplets in the thermal jet recording method, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electrothermal converters arranged corresponding to the sheets or liquid channels holding a liquid (ink), heat energy is generated at the electrothermal converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shaped, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electrothermal converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention. In addition, the present invention can be also effectively made the constitution as disclosed in Japanese Laid-Open Patent Application No. 59-123670 which discloses the constitution using a slit common to a plurality of electrothermal converters as the discharging portion of the electrothermal converter or Japanese Laid-Open Patent Application No. 59-138461 which discloses the constitution having the opening for absorbing pressure wave of heat energy correspondent to the discharging portion.

Further, while the ink jet recording apparatus of the serial type was described in the embodiments, the present invention is also effectively applicable to a recording head of the full line type having a length corresponding to the maximum width of a recording medium which can be recorded by the recording device. As the recording head of the full line type, either the constitution which satisfies its length by a combination of a plurality of recording heads as disclosed in the above-mentioned specifications or the constitution as one recording head integrally formed may be used, and the present invention can exhibit the effects as described above further effectively.

Also, addition of a recovery means for the recording means, a preliminary auxiliary means, etc. provided as the constitution of the recording device is preferable, because the effect of the present invention can be further stabilized. Specific examples of these may include, for the recording head, capping means, cleaning means, pressurization or suction means, electrothermal converters or another type of heating elements, or preliminary heating means according to a combination of these, and it is also effective for performing stable recording to perform preliminary mode which performs discharging separate from recording.

Further, as to the type of the recording head mounted, the kind of ink, and the number of heads, the present invention is effective for a single recording head provided corresponding to monochrome ink or a plurality of recording heads provided corresponding to a plurality of inks having different recording colors or densities, for example, or in any combination thereof. As the recording mode of the recording device, the present invention is extremely effective for not only the recording mode only of a primary color such as black, etc., but also a device equipped with at least one of plural different colors or full color by color mixing.

Though the ink is considered to be liquid in the embodiment as above described, the present invention is applicable to either of the ink solid below room temperature, and softening or liquefying at or above room temperature, or the ink liquefying when a recording enable signal is issued as it is common with the ink jet device to control the viscosity of ink to be maintained within a certain range of the stable discharge by adjusting the temperature of ink in a range from 30 to 70° C. In addition, in order to avoid the temperature elevation due to the heat energy by positively utilizing the heat energy as the energy for the change of state from solid to liquid, or to prevent the ink from evaporating by the use of the ink stiffening in the shelf state, the ink having a property of liquefying only with the application of heat energy, such as the ink liquefying with the application of heat energy in accordance with a recording signal so that liquid ink is discharged, or the ink already solidifying upon reaching a recording medium, is also applicable in the present invention. The most effective method for inks as above described in the present invention is one based on the film boiling as above indicated.

Also, the present invention is effective to an ink jet system of the recording method in which the recording head is placed out of contact with the recording medium for the recording by jetting the ink, such as a piezo-jet method of discharging the ink by converting electricity to force.

Further, the recording apparatus may be used in the form of an output terminal for the information processing equipment such as a word processor or computer, integrally or separately provided, a copying machine in combination with a scanner, or a facsimile terminal equipment having transmission and reception features.

According to the present invention, the optimal driving voltage for the discharge heater provided on the recording head can be determined, with a smaller constitution of the recording head.

What is claimed is:

1. An ink jet apparatus for recording by using a recording head having a drive condition for discharging a predetermined amount of an ink and having integrally a recording chip having an ink discharge unit and an ink container for storing the ink, comprising:

said recording head, said ink discharge unit of said recording head comprising at least one electrothermal converter, said recording head being a separation-type recording head in which a plurality of ink containers can be exchangeably used with said recording chip;

counting means for counting a number of exchanges of the ink container; and altering means for altering said drive conditions for discharging the predetermined amount of the ink for said recording head in accordance with the number of exchanges of the ink containers which have been made for a given said recording chip.

2. The ink jet apparatus according to claim 1, characterized in that said altering means comprises a mechanism for modifying the drive conditions of said recording head mounted when said recording chip in the apparatus is exchanged.

3. The ink jet apparatus according to claim 1, wherein said recording head further comprises:

a plurality of discharge ports disposed in said ink discharge unit; and a plurality of said electrothermal converters, corresponding to respective said discharge ports, for generating heat energy to form a bubble in the ink, wherein said ink jet recording apparatus further comprises supplying means for supplying a drive signal for driving the electrothermal converters in accordance with a recording signal.

4. An ink recording method for recording by supplying an ink from an ink container to a recording chip having an ink discharge unit, comprising the steps of:

counting a number of exchanges of the ink container; and altering at least one ink discharge drive condition for discharging the predetermined amount of the ink for said recording chip in accordance with the number of exchanges of the ink container.

5. The ink recording method according to claim 4, wherein said recording chip has a life which allows a number N of said ink containers to be used therewith, and further comprising the step of:

altering the ink discharge driving conditions to decrease a discharge amount when N increases, whereby said recording chip discharges the ink equally for each said ink container.

6. The ink recording method according to claim 4, wherein said ink discharge driving conditions at least partially define a drive signal comprising a preheating signal and a bubble forming signal, each with a certain interval, which are supplied to a plurality of electrothermal converters in the ink discharge unit in accordance with a recording signal, and said altering serves to reduce an energy supplied by said preheating signal in accordance with said amount of said ink which has been supplied.

7. The ink recording method according to claim 5, wherein said ink discharge driving conditions are a setting reference for adjusting at least one of a temperature of said recording chip and a temperature of the ink, and said altering serves to reduce said setting reference in accordance with said amount of said ink which has been supplied.

8. The ink recording method according to claim 4, wherein said recording chip comprises a plurality of discharge ports as said ink discharge unit and a plurality of electrothermal converters, corresponding to respective said discharge ports, for generating heat energy to form a bubble in the ink, and further comprising the step of:

discharging the ink by supplying a drive signal for driving the electrothermal converters in accordance with a recording signal.

9. An ink recording method for recording by supplying an ink from an ink container attached thereto to a recording chip having an ink discharge unit, comprising the steps of:

providing said ink container and said recording chip;

counting a number of exchanges of the ink container; and altering at least one ink discharge drive condition for discharging a predetermined amount of the ink for said recording chip in accordance with the number of exchanges of the ink container and an ink jet consumption rate within the ink container attached thereto.

10. The ink recording method according to claim 9, wherein said recording chip comprises a plurality of discharge ports as said ink discharge unit and a plurality of electrothermal converters, corresponding to respective said discharge ports, for generating heat energy to form a bubble in the ink, and further comprising the step of:

discharging the ink by supplying a drive signal for driving the electrothermal converters in accordance with a recording signal.

* * * * *